US005662725A

United States Patent [19]

Cooper

[11] Patent Number: 5,662,725

[45] Date of Patent: Sep. 2, 1997

[54] SYSTEM AND DEVICE FOR REMOVING IMPURITIES FROM MOLTEN METAL

[76] Inventor: Paul V. Cooper, 11247 Lake Forest Dr., Chesterland, Ohio 44026

[21] Appl. No.: 439,739

[22] Filed: May 12, 1995

[51] Int. Cl.[6] ..... B22D 41/58

[52] U.S. Cl. ..... 75/680; 266/217; 222/603

[58] Field of Search ..... 266/239, 237, 266/236, 217, 44; 222/594, 590, 603; 75/501, 602, 680, 708

[56] References Cited

U.S. PATENT DOCUMENTS

| | | | |
|---|---|---|---|
| 1,100,475 | 6/1914 | Franckaerts . | |
| 1,896,201 | 2/1933 | Sterner-Rainer . | |
| 2,787,873 | 4/1957 | Hadley . | |
| 2,821,472 | 1/1958 | Peterson et al. . | |
| 2,865,618 | 12/1958 | Abell . | |
| 2,948,524 | 8/1960 | Sweeney et al. . | |
| 2,984,524 | 5/1961 | Grasselli et al. . | |
| 2,987,885 | 6/1961 | Hodge . | |
| 3,048,384 | 8/1962 | Sweeney et al. . | |
| 3,070,393 | 12/1962 | Silverberg et al. . | |
| 3,092,030 | 6/1963 | Wunder . | |
| 3,251,676 | 5/1966 | Johnson . | |
| 3,255,702 | 6/1966 | Gehrm . | |
| 3,291,473 | 12/1966 | Sweeney et al. . | |
| 3,459,346 | 8/1969 | Tinnes . | |
| 3,618,917 | 11/1971 | Fredrikson et al. . | |
| 3,650,730 | 3/1972 | Derham et al. . | |
| 3,689,048 | 9/1972 | Foulard et al. . | |
| 3,715,112 | 2/1973 | Carbonnel . | |
| 3,743,263 | 7/1973 | Szekely . | |
| 3,743,500 | 7/1973 | Foulard et al. . | |
| 3,753,690 | 8/1973 | Emley et al. . | |
| 3,759,635 | 9/1973 | Carter et al. . | |
| 3,767,382 | 10/1973 | Bruno et al. . | |
| 3,836,280 | 9/1974 | Koch . | |
| 3,839,019 | 10/1974 | Bruno et al. . | |
| 3,886,992 | 6/1975 | Maas et al. . | |
| 3,954,134 | 5/1976 | Maas et al. . | |
| 3,961,778 | 6/1976 | Carbonnel et al. . | |
| 3,984,234 | 10/1976 | Claxton et al. . | |
| 4,003,560 | 1/1977 | Carbonnel . | |
| 4,052,199 | 10/1977 | Mangalick | 266/217 |
| 4,169,584 | 10/1979 | Mangalick | 266/217 |
| 4,351,514 | 9/1982 | Koch . | |
| 4,410,299 | 10/1983 | Shimoyama . | |
| 4,537,624 | 8/1985 | Tenhover et al. . | |

(List continued on next page.)

OTHER PUBLICATIONS

Demagging Aluminum, Metaullics, Technical Bulletin 87–10, Apr. 1987 This new Metaullics™ M Series transfer pump runs up to three times longer than its closest competitor, Metaullics (one page).

Metaullics® M–Series Pumps, Standard Oil Engineereed Materials, Form C–1290 Effective Mar. 1987, Supercedes Apr. 1984.

Metaullics® De–Gas/DeMag Systems for Aluminum, Metaullics Systems, Form C–1300, Apr. 1, 1985.

*Primary Examiner*—Scott Kastler
*Attorney, Agent, or Firm*—Jones, Day, Reavis & Pogue

[57] ABSTRACT

A system and device for removing impurities from molten metal comprising a pump within a chamber having an outlet port. The pump creates a flow or stream of molten metal through the outlet port. One or more gas-release tubes are provided adjacent the outlet port, each gas-release tube having one or more gas-release openings adjacent the outlet port. Gas is introduced into the gas-release tube(s) whereby it escapes through the openings into the molten metal stream thereby removing impurities from the molten metal. The system may further comprise a gas-release block, having one or more openings, mounted adjacent the bottom of the outlet port, partially within the molten metal flow. Gas is introduced into the block through a gas-transfer device where the gas escapes through the openings and enters the lower portion of the molten metal stream. Finally, the system may further comprise a metal-transfer device for containing the molten metal stream. The gas-release device communicates with the channel and releases gas into the channel into the molten metal stream.

22 Claims, 20 Drawing Sheets

U.S. PATENT DOCUMENTS 4,537,625 8/1985 Tenhover et al. .
4,557,766 12/1985 Tenhover et al. .
4,609,442 9/1986 Tenhover et al. .
4,696,703 9/1987 Henderson et al. .
4,701,226 10/1987 Henderson et al. .
4,770,701 9/1988 Henderson et al. .
4,786,230 11/1988 Thut .
4,810,314 3/1989 Henderson et al. .
4,842,227 6/1989 Harrington et al. .
4,851,296 7/1989 Tenhover et al. .
4,859,413 8/1989 Harris et al. .
4,898,367 2/1990 Cooper .
4,923,770 5/1990 Grasselli et al. .
4,973,433 11/1990 Gilbert et al. .
5,092,821 3/1992 Gilbert et al. .
5,098,134 3/1992 Monckton .
5,131,632 7/1992 Olson .
5,203,681 4/1993 Cooper ..... 417/424.1
5,330,328 7/1994 Cooper .
5,454,423 10/1995 Tsuchida et al. ..... 266/239

SYSTEM AND DEVICE FOR REMOVING IMPURITIES FROM MOLTEN METAL

FIELD OF THE INVENTION

The present invention relates to a system and device for releasing gas into a fluid medium and, in particular, for releasing gas into molten metal for the purpose of removing impurities.

BACKGROUND OF THE INVENTION

It is known in the art of smelting and purifying metals to introduce gas into molten metal to remove impurities. Specifically, when processing molten aluminum, it is desirable to remove dissolved gases, particularly hydrogen, or dissolved metals, particularly magnesium. Those skilled in the art refer to removing dissolved gas from molten aluminum as "degassing", and refer to removing magnesium as "demagging." Nitrogen or argon is generally released into molten metal for degassing while chlorine gas is generally used for demagging. The present invention is particularly directed to the process of demagging, although it can also be used for degassing.

When demagging or degassing aluminum, chlorine or nitrogen gas, respectively, is released into a quantity of molten aluminum, this quantity generally being referred to as a bath of molten aluminum. The bath is usually contained within the walls of a reverbatory furnace. When demagging aluminum, chlorine gas is released into the bath and the chlorine bonds, or reacts, with the magnesium wherein each pound of magnesium reacts with approximately 2.95 pounds of chlorine to form magnesium chloride ($MgCl_2$). Several methods for introducing chlorine into a molten aluminum bath are disclosed in the prior art.

For example, U.S. Pat. No. 3,650,730 to Derham et al. discloses introducing a flux, rather than chlorine gas, into molten aluminum to demag the aluminum. The flux contains a double salt of chlorine, such as Cryolite. U.S. Pat. No. 3,767,382 to Bruno et al. discloses an apparatus whereby chlorine gas is introduced through a rotating hollow shaft and impeller arrangement into the center of a pump chamber contained within the molten aluminum. U.S. Pat. No. 4,169,584 to Mangalick discloses a gas-injection system including a pump, a metal-transfer conduit and a gas-injection conduit connected to the top of the metal-transfer conduit. In the Mangalick disclosure, molten aluminum is pumped through the metal-transfer conduit and gas is injected into the upper portion of the pumped molten metal moving through the conduit. In practice, the actual product made by the assignee of the Mangalick patent has a gas-injection conduit connected to and extending through the top of the metal-transfer conduit into the upper portion of the pumped molten metal. As the molten metal moves past the submerged end of this gas-injection conduit, chlorine gas is introduced into the stream through a hole in the bottom of the gas-injection conduit.

U.S. Pat. No. 4,351,314 to Koch discloses a molten metal pump and gas-injection apparatus. The pump includes a pump casing having an inlet and an outlet port. An impeller is enclosed by the pump casing. The gas-injection apparatus comprises a tube having a first end connected to a gas source and an output end positioned within the molten metal bath, the output end being connected to a collar mounted on the pump casing, wherein the collar has a passage that communicates with the inlet. Gas is introduced through the tube into the passage and is released into the molten metal entering the inlet.

U.S. Pat. No. 4,003,560 to Carbonnel discloses a gas-treatment device comprising a purification device, which is immersible in a molten metal bath contained within a furnace, and a decanting and degassing tank located outside of the bath. Gas is introduced via a pipe into the purification device and the molten metal is pumped from the purification device into a decanting and degassing tank. The gas is then separated from the molten metal and the purified molten metal is drawn from the tank by a spout.

One problem with the prior art devices is that the chlorine gas is usually introduced into the molten metal near, or in an area enclosed by, machinery or equipment, particularly pumping equipment, which tends to rapidly clog and bind the equipment because the $MgCL_2$ formed in the demagging process can adhere to equipment surfaces. For example, in the previously-described Mangalick device, chlorine gas is introduced into a metal-transfer conduit via a gas-injection conduit. The magnesium and chlorine react inside of the conduit and form $MgCl_2$, which can adhere to the surface of the conduit and eventually clog it. This often occurs during start-up periods when the metal is cool and its flow rate is low. The Mangalick device is especially prone to clogging because: 1) the gas is released through a single, relatively large opening, 2) the opening is formed at the end of a relatively wide conduit, and 3) the conduit extends into the molten metal stream from the top of the metal-transfer conduit. As the pumped metal moves past the conduit, a low-pressure zone is created behind the conduit. The injected gas exits the gas-injection conduit and immediately enters the low pressure zone behind the conduit. There, it rises until it contacts the inner surface of the top of the metal transfer conduit. A large percentage of gas injected using this device contacts the inner surface and remains in contact with this surface until it exits the metal-transfer conduit. Magnesium chloride, therefore, tends to form along this surface.

Some other known gas-injection pumps, such as the previously described Koch device, introduce chlorine gas at a location within the molten metal bath where the gas can enter the pump chamber. The chlorine gas bonds with magnesium to form $MgCl_2$ and the $MgCl_2$ can bond to equipment surfaces thereby clogging the pump chamber or the outlet port, or binding the impeller.

Another problem with the prior art devices is that their efficiency is relatively low, the demagging efficiency being measured by the percentage of chlorine introduced into the molten metal that actually bonds with magnesium to form $MgCl_2$. The efficiency of the prior art devices is low generally because: 1) the gas is not introduced into a pumped molten metal stream, but instead into relatively slow-moving molten metal, sometimes at a position where gravity is moving the molten metal through a restricted opening or conduit between two chambers, 2) the gas is introduced into or near a pumped molten metal stream but is introduced at a location where the gas is not dispersed throughout the stream and/or is not contained within the stream for a long enough period, and 3) the gas is introduced in large bubbles, which have a relatively small surface area, as compared to smaller bubbles, for a given quantity of gas.

Even a device that confines the chlorine gas and molten metal in an enclosed area, such as the one described in U.S. Pat. No. 4,169,584 to Mangalick, which confines the chlorine gas and molten metal stream within a metal-transfer conduit, is relatively inefficient. As previously described, this device includes a gas-injection conduit that extends through the top of a metal-transfer conduit, the part of the gas-injection conduit that extends into the metal-transfer conduit having an outside diameter of approximately 1⅝"–2". When the molten metal stream moving through the metal-transfer conduit contacts the gas-injection conduit, it is obstructed by and diverted around the gas-injection conduit creating a low pressure zone behind the gas-injection conduit. At least some of the gas released through the bottom opening in the gas-injection conduit immediately enters the low pressure zone and quickly rises to the inner surface of the top of the metal-transfer conduit and is not swept into the moving stream. Therefore, the gas is not well dispersed within the stream and interaction between the gas and the molten metal is limited. As it will be appreciated by those skilled in the art, the greater the dispersion of gas within the molten metal stream the greater the demagging efficiency because the gas molecules contact a higher number of metal molecules, thus giving more molecules the chance to interact and bond to form $MgCL_2$.

In the Mangalick device, and other known devices, the interaction between the gas and the molten metal is further limited because the gas is introduced into the molten metal through a single opening approximately ½" to ¾" in diameter. As gas is released through this relatively large opening, large gas bubbles are formed. As explained previously, a given quantity of gas introduced into the molten metal as large bubbles does not have as great of an overall surface area as the same quantity of gas introduced into the molten metal as smaller bubbles. As it will be understood by those skilled in the art, the greater the surface area of the gas interfacing with the molten metal, the greater the demagging efficiency. Furthermore, small bubbles are more easily dispersed throughout the molten metal stream.

Improving the efficiency of the demagging process reduces material costs because less chlorine gas is used. Furthermore, chlorine gas that does not bond with magnesium either bonds with aluminum to form aluminum trichloride or rises to the top of the molten metal bath and escapes into the atmosphere, where it is an undesirable pollutant. A higher efficiency reduces the amount of chlorine gas released into the atmosphere.

Additionally, the known gas-injection or gas-release devices do not lift, or transport, molten metal to the surface. These devices generally release large bubbles that are not well dispersed within the flowing stream and the large gas bubbles simply rise through the molten metal to the top of the bath rather than lifting a portion of the molten metal steam upward. Therefore, the surface of the bath usually has a solid crust of metal and impurities on it. When scrap metal is placed in the bath, it often will rest on the crust and not sink into the molten metal where it would melt and be recycled. To solve this problem, circulation pumps or other devices are used to circulate the molten metal and melt the crust. A device that would melt enough of the crust to allow scrap to sink, without the added expense of a circulation pump, would save the cost of the circulation pump and the cost of maintaining it.

SUMMARY OF THE INVENTION

The aim of the present invention is to eliminate the binding or clogging of pump equipment and to increase the efficiency of demagging aluminum as compared to prior art devices and to circulate the molten metal so as to sink scrap. To this end, a system and device is provided that comprises a gas-release device and a pump that is preferably a molten metal pump having a pump chamber with an outlet port. The pump creates a high-speed flow or stream of molten metal exiting from the outlet port. The gas-release device, which preferably comprises one or more gas-release tubes, releases gas into an area not enclosed by a machine, equipment or a conduit and does not substantially obstruct the flow of the stream. The gas-release tube(s) is positioned outside of the pump chamber adjacent one or both sides of the outlet port of the pump and adjacent the molten metal stream exiting the outlet port. Openings are formed in the gas-release tube(s), the openings being positioned adjacent the side(s) of the outlet port. A gas source is connected to the gas-release device and gas is introduced into the gas-release device where it exits through the openings and enters the molten metal stream exiting the outlet port. Importantly, the gas-release device is positioned where it does not significantly disrupt the molten metal flow. The invention may comprise one gas-release device positioned adjacent one side of the outlet port, one gas-release device positioned adjacent the bottom of the outlet port, or a plurality of gas-release device positioned adjacent one or both sides of the outlet port.

In another embodiment of the present invention, a system is provided that includes a pump including a pump chamber having an outlet port, a gas-release device and a gas-transfer device. The gas-release device is preferably a graphite block positioned adjacent the bottom of the outlet port. The gas-release device is connectable to, or integrally formed with, the gas-transfer device and has one or more bores through which the gas is released. Gas is introduced into the gas-release device via the gas-transfer device where it escapes through the bores in the gas-release device and is thereby released into the lower portion of the molten metal stream.

In another embodiment of the present invention, which also increases the efficiency of demagging or degassing aluminum while not binding or clogging pump equipment, gas is released into the bottom, center or side portion of a metal-transfer device. In this embodiment, there is provided a pump having a pump chamber including an outlet port and a metal-transfer device, which is preferably a metal-transfer conduit connected to the outlet port. The metal-transfer device defines a channel through which the molten metal flows. A gas-release device is preferably connected to, or inserted into, or integrally formed with, or otherwise communicates with, the metal-transfer device. The pump creates a high-speed molten metal stream moving through the channel defined by the metal-transfer device. The gas-release device preferably includes a plurality of small openings communicating with the channel that release gas into the molten metal stream moving through the channel. The small openings create relatively small bubbles of gas, as compared to the large bubbles formed by the prior art devices. The gas-release device releases bubbles into either the bottom, side or center portion of the channel through which the molten metal stream passes. The gas is swept into, and is dispersed throughout, the stream and the gas and molten metal are contained by the metal-transfer device so as to improve the interface therebetween.

In an embodiment for releasing gas into the center of the stream, a gas-release device is provided that includes small diameter gas-release tube(s) or blade(s), preferably having relatively small openings in the body portion, rather than in the end, through which the gas is released. The tube(s) or blade(s) extend into the channel of the metal-transfer device from either the bottom, one or both sides, or the bottom and sides. The relatively small diameter, as compared to the prior art, tube(s) or blade(s) does not significantly interrupt the flow pattern of the stream, thereby greatly reducing the low pressure zone behind the gas-release tube or blade. Further, because the released gas rises, it will not enter the low pressure zones created behind tubes or blades extending into the channel from the sides or bottom. Furthermore, the small openings release small gas bubbles that more thoroughly interface with the pumped molten metal.

Finally, in another embodiment of the present invention, a system and device are provided for releasing gas near either the center or lower portion of a molten metal stream. This invention includes a gas-release device that extends through the upper portion of the molten metal stream into the center or lower portion of the stream. The gas-release device is relatively narrow, as compared to the prior art devices, having an outer diameter of 1¼" or less, so that the low pressure zone formed behind it is small. Preferably the openings formed in this gas-release device are small so that small bubbles are released into the pumped molten metal stream. Further, the openings are preferably formed in the body, rather than the end of the gas-release device, so that the released gas is swept into the moving stream and does not enter the low pressure zone.

It is therefore an object of the invention to provide system and device for introducing gas into a molten metal bath.

It is a further object of the present invention to introduce gas into a molten metal stream or flow.

It is a further object of the invention to improve the dispersion of gas within a molten metal stream.

It is a further object of the invention to introduce gas into a molten metal stream without significantly disrupting the flow pattern of the stream.

It is a further object of the invention to increase the efficiency of demagging and degassing aluminum.

It is a further object of the present invention to submerse scrap.

It is a further object of the invention to demag aluminum without clogging or binding pumping equipment.

It is a further object of the invention to improve the efficiency of demagging aluminum by dispersing small gas bubbles into a molten aluminum stream containing magnesium so as to increase the overall surface interface between the gas and the molten metal.

It is a further object of the present invention to introduce gas into the lower portion, one or both side portions or center of a molten metal stream so as to improve the dispersion of gas within the stream and increase the time the gas remains within the stream.

It is a further object of the invention to provide a system for removing impurities from molten metal, the system comprising a pump having a pump chamber including an outlet port and gas-release device positioned outside of the pump chamber adjacent the outlet port.

It is a further object of the invention to provide a system as described above wherein the molten metal is aluminum and the gas is chlorine.

It is a further object of the invention to provide a system as described above wherein the gas is nitrogen or argon.

It is a further object of the invention to provide a system as described above wherein the gas-release device comprises two graphite tubes, one adjacent either side of the outlet port. Each graphite tube has one or more openings adjacent a side of the outlet port, gas escaping through the opening(s) into the molten metal stream exiting the outlet port.

It is a further object of the invention to provide a system for removing impurities from molten metal comprising a pump having a pump chamber including an outlet port, a gas-release device positioned outside of the pump chamber and adjacent the bottom of the outlet port, and a gas-transfer device connectable to the gas-release device.

It is further object of the present invention to provide a system for removing impurities from molten metal comprising a pump having an outlet port, a metal-transfer device defining a channel communicating with the outlet port and a gas-release device for releasing gas into the bottom portion, one or both side portions or center of the channel defined by the metal-transfer device.

It is further object of the present invention to provide a system having a metal-transfer device as described above wherein the gas-release device has one or more relatively small openings to create small gas bubbles.

It is further object of the present invention to provide a system having a metal-transfer device as described above wherein the gas-release device does not significantly obstruct the flow of the stream and does not create a low pressure zone.

DETAILED DESCRIPTION OF A PREFERRED EMBODIMENT

Figure 1:
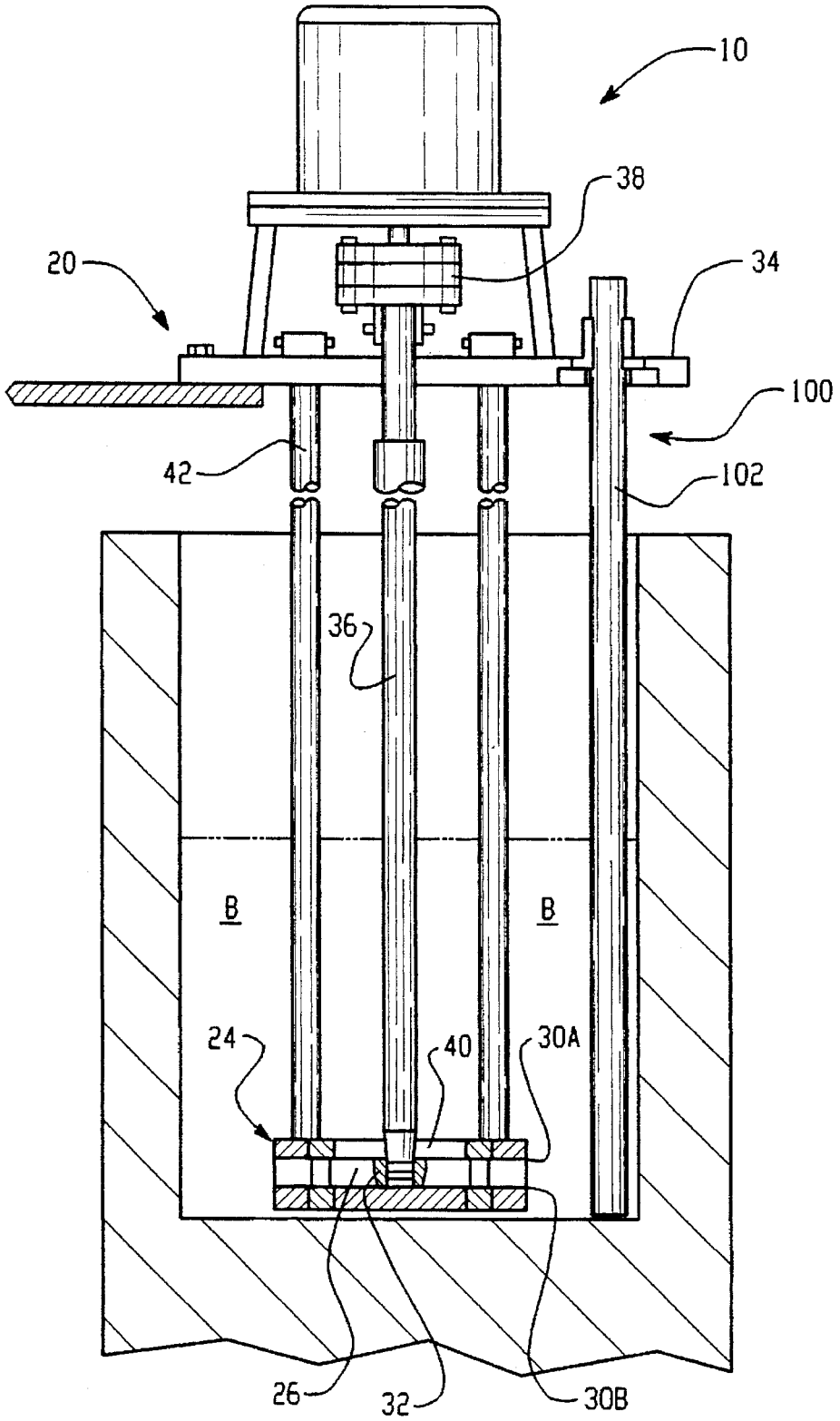
FIG. 1 is a front view of a system and device including a pump and a gas-release device in accordance with the present invention.

Referring now to the drawings where the purpose is to illustrate and describe a preferred embodiment of the invention, and not to limit same, FIG. 1 shows a system 10 in accordance with the present invention. System 10 includes a pump 20 and gas-release device 100.

Figure 1A:
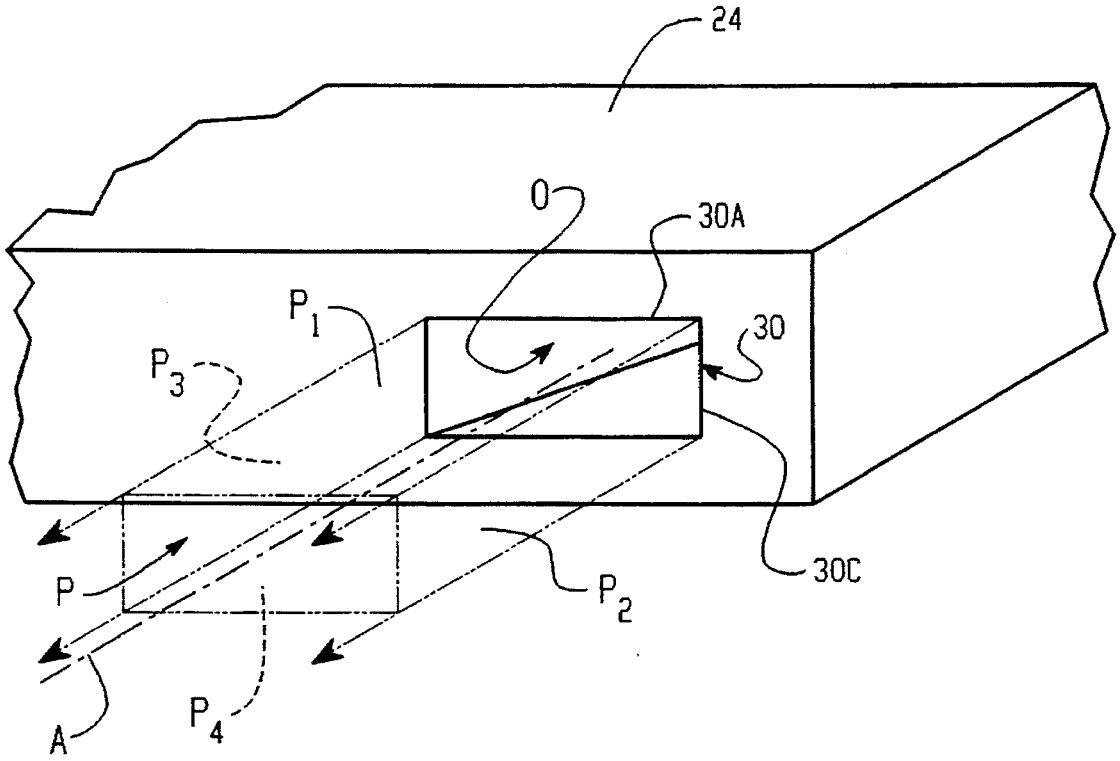
FIG. 1A is a partial, enlarged, perspective view of the pump casing shown in FIG. 1 showing the outlet port and a space P.
Figure 2:
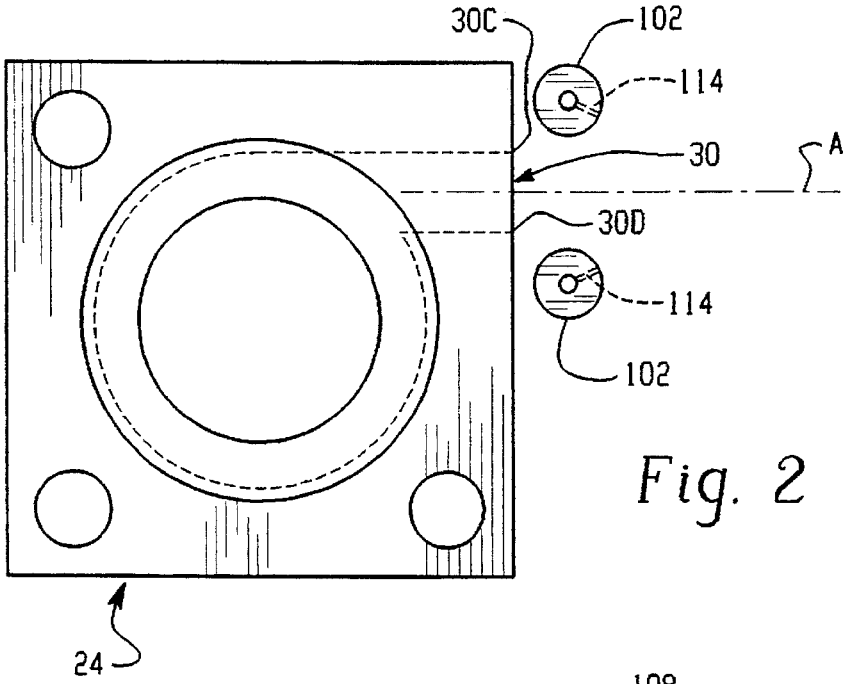
FIG. 2 is a top view of the pump casing and the gas-release device shown in FIG. 1.

Pump 20 is specifically designed for operation in molten metal furnaces or in any environment in which molten metal is to be pumped. Pump 20 can be any structure or device for pumping or otherwise moving molten metal whereby the metal is moved preferably at a speed of at least 5 ft./sec. and most preferably at a speed of 10 ft./sec. or faster through a restricted opening to form a stream or flow of molten metal. The preferred minimum speed of 5 ft./sec is required so that the gas released into the moving molten stream is swept into the stream instead of simply rising vertically through the stream, thus improving the interaction between the gas and the molten metal. A preferred pump 20 is disclosed in U.S. Pat. No. 5,203,681 to Cooper entitled "Submersible Molten Metal Pump", the disclosure of which is incorporated herein by reference. Basically, the preferred embodiment, which is best seen in FIGS. 1 and 2, is a pump 20 having a pump base 24 submersible in a molten metal bath B. Pump base 24 includes a generally cylindrical pump chamber 26 having an inlet 40 at the top and a tangential discharge opening, or outlet port, 30, and a triangular shaped rotor, or impeller, 32 contained within the pump chamber 26. Outlet port 30 has a top 30A, a bottom 30B and sides 30C and 30D. As used herein, the term outlet port refers to any opening through which pumped molten metal exits a confined area to enter the bath B. The preferred outlet port 30 of the invention is one that is formed as part of pump base 24, as shown. Outlet port 30 defines an opening O, the movement of opening O along axis A defining a space P, shown in FIG. 1A. Support posts 42 connect base 24 to the superstructure 34 of the pump thus supporting superstructure 34. A drive shaft 36 is connected at one end to rotor 32 and at the other end to coupling 38. Pump 20 is usually positioned in a pump well, which is part of the open well of a reverbatory furnace.

Space P is defined along axis A between a plane P1, which extends from top 30A along axis A, a plane P2, which extends from side 30B along axis A, a plane P3, which extends from side 30C along axis A and a plane P4, which extends from bottom 30D along axis A. As used herein: the expression: the lower portion of the stream, refers to any position below axis A; the expression: the top portion of the stream, refers to any position above axis A; the expression: the side portion of the stream refers to any position on either side of axis A, i.e., relative either P2 or P3. Unless specifically stated otherwise, these positions are not limited by the boundaries of planes P1, P2, P3 and P4 and are not limited by the actual boundary of the molten metal stream. This nomenclature is intended to serve as a relatively simple way to refer to the position of various components of the invention.

Figure 1B:
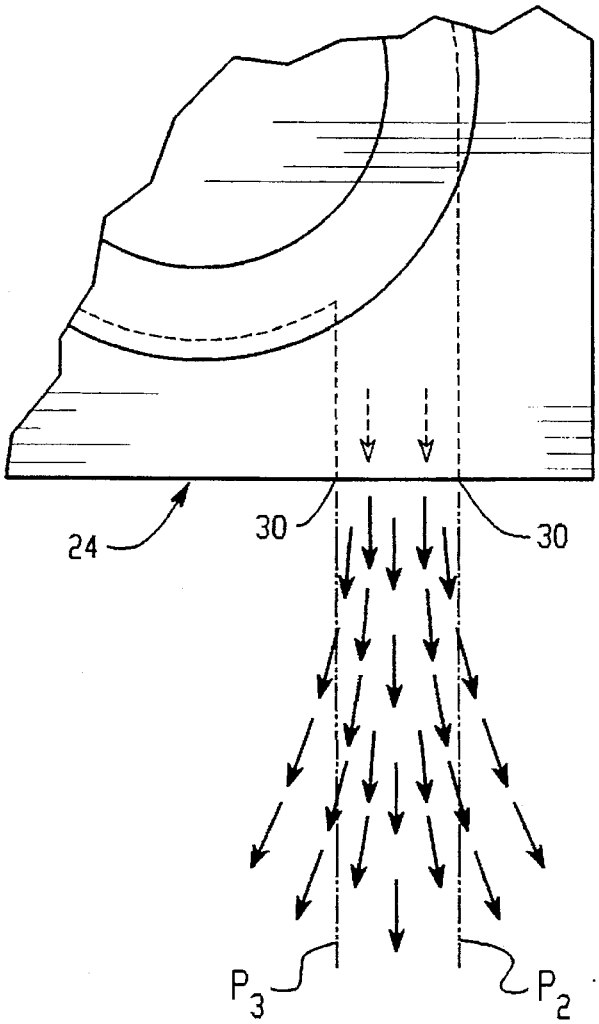
FIG. 1B is a top view of a pump chamber depicting the fanning of a molten metal stream exiting the outlet port.
Figure 1C:
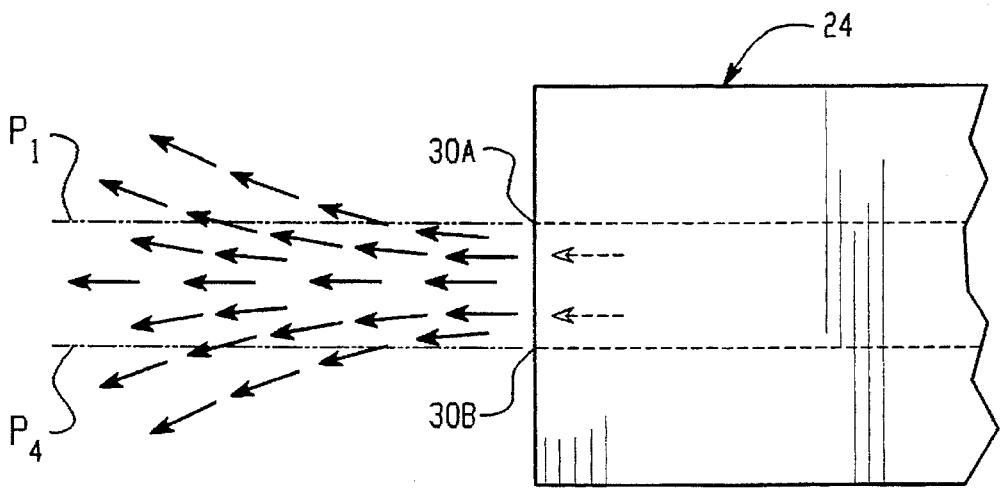
FIG. 1C is a side view of a pump chamber depicting the fanning of a molten metal stream exiting the outlet port.

When molten metal is pumped by pump 20, a flow or stream of molten metal exiting outlet port 30 is created. As shown in FIGS. 1B and 1C, the molten metal stream exiting the outlet port fans out, or disperses, in all directions after it enters bath B.

Figure 3:
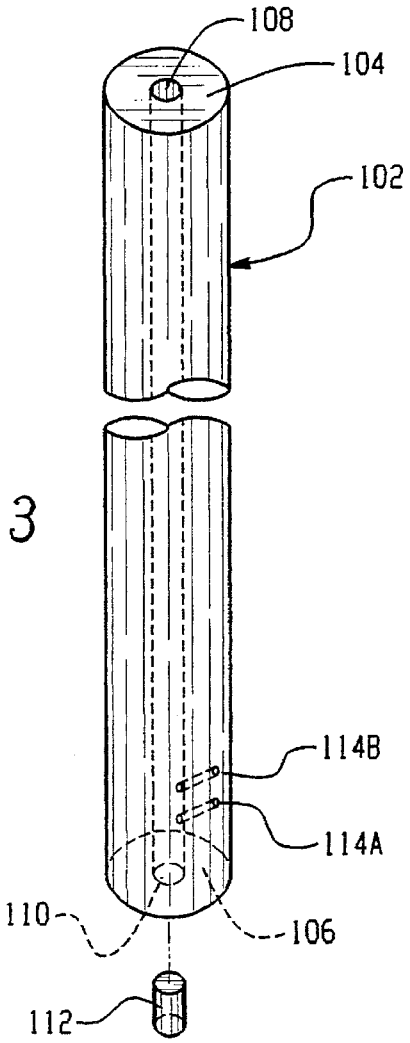
FIG. 3 is a perspective view of a preferred gas-release device of the system shown in FIGS. 1 and 2.

As is shown in FIGS. 1, 2 and 3, a gas-release device 100 preferably comprises one or more elongated graphite conduits or tubes 102. The tubes could also be refractory material, refractory referring to any ceramic material that would function in a molten metal environment. Graphite tube 102 is preferably formed of graphite impregnated with an oxidation-resistant solution, this material being readily available and well known to those skilled in the art. In a preferred embodiment, tube 102 has an outside diameter of 2" to 3" and an inside diameter of ½" to ¾", it being understood that tubes having other dimensions could also be used.

Tube 102 is hollow, has a first end 104 and a second end 106. First end 104 has an opening 108 and second end 106 has an opening 110, opening 110 being plugged by plug 112. Plug 112 is preferably formed of the same material as tube 102, is approximately one inch long, and has an outside diameter approximately equal to the inside diameter of tube 102 so that when it is inserted into opening 110 of end 106, it forms a gas-tight seal, end 106 then being referred to as closed. Plug 112 is preferably cemented or threadingly received into end 106, although other attachment means may be used. Furthermore, structures other than plug 112 can be used to close opening 110. Additionally, tube 102 could be provided without opening 110, end 106 again being referred to as closed.

Openings 114 are located adjacent second end 106 of tube 102. Openings 114 are preferably circular, 1/16" to 3/8" in diameter, and communicate with the hollow center of tube 102. The tube 102 of a preferred embodiment includes two openings, 114A and 114B, wherein opening 114A is positioned just above plug 112 and opening 114B is positioned ½" to 1" above opening 114A, as measured from the center of opening 114A to the center of opening 114B. The selection of two openings, positioned as described, is an optimal arrangement as this has been found to produce the smallest size and highest number of gas bubbles, while still allowing enough gas throughput to demag aluminum in a standard manufacturing operation. Alternatively, one opening, or more than two openings, could be used, and the opening sizes, shapes and the spacings between openings could be different. Furthermore, openings 114 could be covered by a porous substance, such as a ceramic, or the end of tube 102 could simply contain a porous ceramic plug or extension through which the gas escapes into the metal stream.

The length of tube 102 will vary depending on the type of pump used. Optionally, however, the length of tube 102 should be such that opening 114A is positioned ½" to ¾" from the bottom of outlet port 30, as this yields the best demagging results. Preferably, too, tube(s) 102 are affixed to superstructure 34, as shown in FIG. 1, so as to stabilize and properly position the tube(s), although any other method of stabilizing tube(s) 102 would suffice . In a preferred embodiment, tube 102 is approximately 48"–72" in length.

Figure 4:
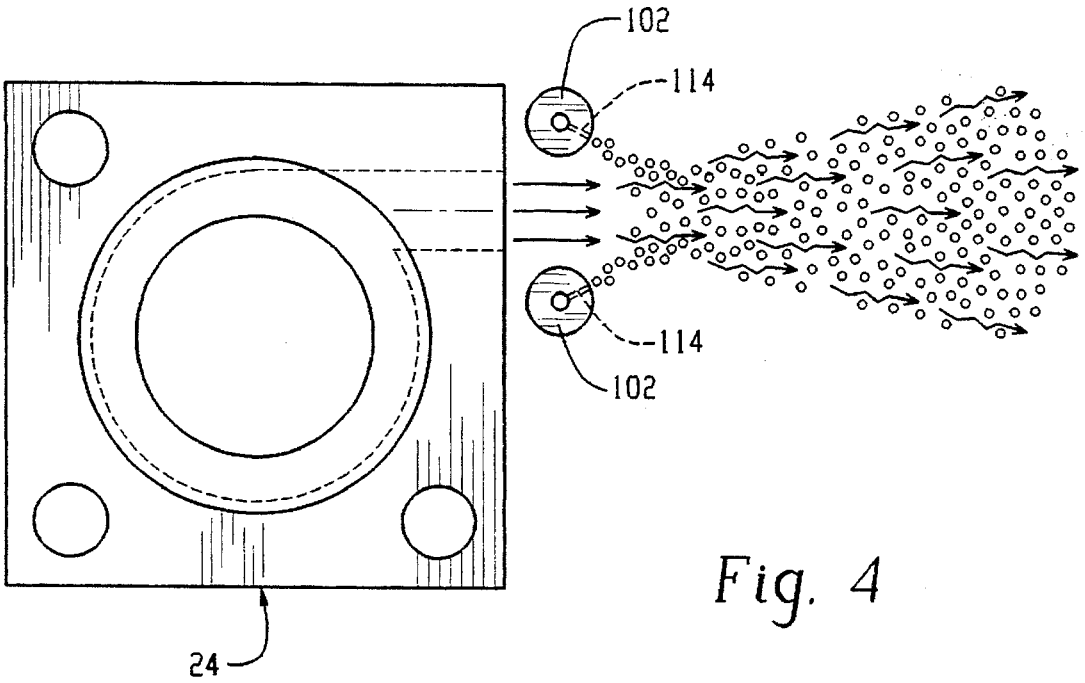
FIG. 4 is the view shown in FIG. 2 illustrating gas being released into a molten metal stream.

Turning now to FIG. 2, a preferred embodiment is shown having a tube 102, as described above, positioned on either side, 30C and 30D, of outlet port 30, each tube 102 having openings 114A and 114B, as described above. Tube(s) 102 are preferably spaced about 1/16" to ½", and not more than 1½", from base 24, although tube(s) 102 could touch base 24 or be spaced further from base 24. Tubes 102 are preferably oriented so that openings 114 are positioned at a 0°–60°, and preferably a 15°–25° downstream angle relative the molten metal stream. The term downstream referring to that portion of the molten metal stream that has exited outlet port 30 and has passed beyond gas-release device 100. The 15°–25° downstream angle relative to the molten metal stream is best illustrated in FIGS. 2 and 4. It will be understood, however, that the specific angle is merely a preferred embodiment and could be varied, as long as it is such that when the gas is released it enters and is dispersed within the molten metal stream.

In operation, a gas supply is connected to opening 108 of tube 102, and gas is introduced into the hollow cavity of tube 102, the gas then escaping through openings 114 and effusing into the molten metal stream, as shown in FIG. 4, wherein the flow of the molten metal stream is represented by arrows.

Gas-release device 100 is positioned adjacent one or both sides 30C, 30D of outlet port 30, where it does not significantly interfere with or disrupt the molten metal stream or flow. The term adjacent, in this context, meaning that gas-release device 100 preferably be positioned flush with one or both sides 30C, 30D of outlet port 30, as shown in FIGS. 2 and 4, and not block or obstruct the metal flow, as this yields the best results. Satisfactory results have been achieved, however, when gas-release device 100 extends up to 1" into space P from plane P2 and/or P3. This 1" arrangement has been found to not obstruct the flow pattern of the stream to such a degree that it interferes with the dispersion of gas within the molten metal. The term adjacent, therefore, when used in relation to this embodiment of the invention, encompasses orientations in which the gas-release device extends up to 1" into space P from plane P2 and/or P3. Other embodiments of gas-release device 100 may extend further than 1" into space P and not substantially disrupt the molten metal flow. For example, gas-release device 100 may comprise one or more tubes extending horizontally into space P from one or both planes P2, P3, or extending vertically upward into space P from plane P4.

Furthermore, the two-tube structure shown in FIGS. 2 and 4 is a preferred embodiment. The scope of the present invention also covers the use of only one tube or more than two tubes.

Figure 10:
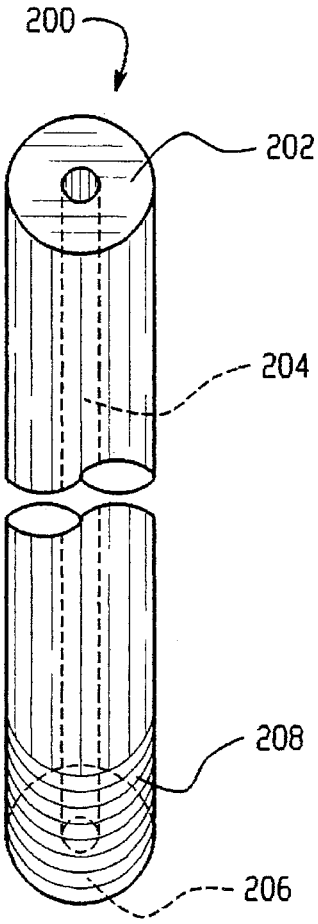
FIG. 10 is a perspective view of a preferred gas-transfer device of the embodiment shown in FIGS. 5 and 6.

Turning now to FIGS. 5–10, an alternative embodiment of the present invention is shown that includes a gas-transfer device 200 connected to a gas-release device 300. Gas-transfer device 200, best seen in FIG. 10, is preferably a hollow graphite tube and is preferably made from the same material, and is of the same general shape and dimensions as the previously described gas-release tube 102. Any shape or size conduit, however, capable of transferring gas in the environment of a molten metal furnace could be used as gas-transfer device 200. For example, gas-transfer device 200 could be a hollow refractory tube made of castable ceramic or even high-temperature hosing made from a ceramic fabric. Preferred device 200 has a first open end 202 and a cylindrical inner cavity 204 extending axially therethrough. A second open end 206 has external threads 208 formed thereon.

Gas-release device 300, best seen in FIGS. 5–9, is preferably a rectangular graphite block 302 having dimensions of approximately 2"×3½"×9", although a structure formed of any material and having any shape and any dimension capable of releasing gas into a molten metal stream or flow could be used. Block 302 has a top surface 304, which is preferably planar or stepped, with an inlet bore 306 formed therein. Bore 306 is preferably threaded and has an inside diameter dimensioned to threadingly receive external threads 208 of end 206 of gas-release device 200. Bore 306 extends approximately 1½" into block 300. A passageway 308 is formed through a side 310 of block 302. Passageway 308 communicates with bore 306, and is preferably cylindrical and ½" in diameter. A plug 312 is provided, which is preferably formed of graphite, and is received in passageway 308 at side 310 to form a gas-tight seal, it being understood that other structures or devices could be used to create the gas-tight seal.

Figure 8:
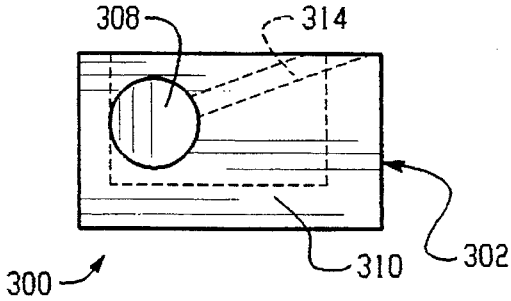
FIG. 8 is a side view of the gas-release device shown in FIG. 7.
Figure 9:
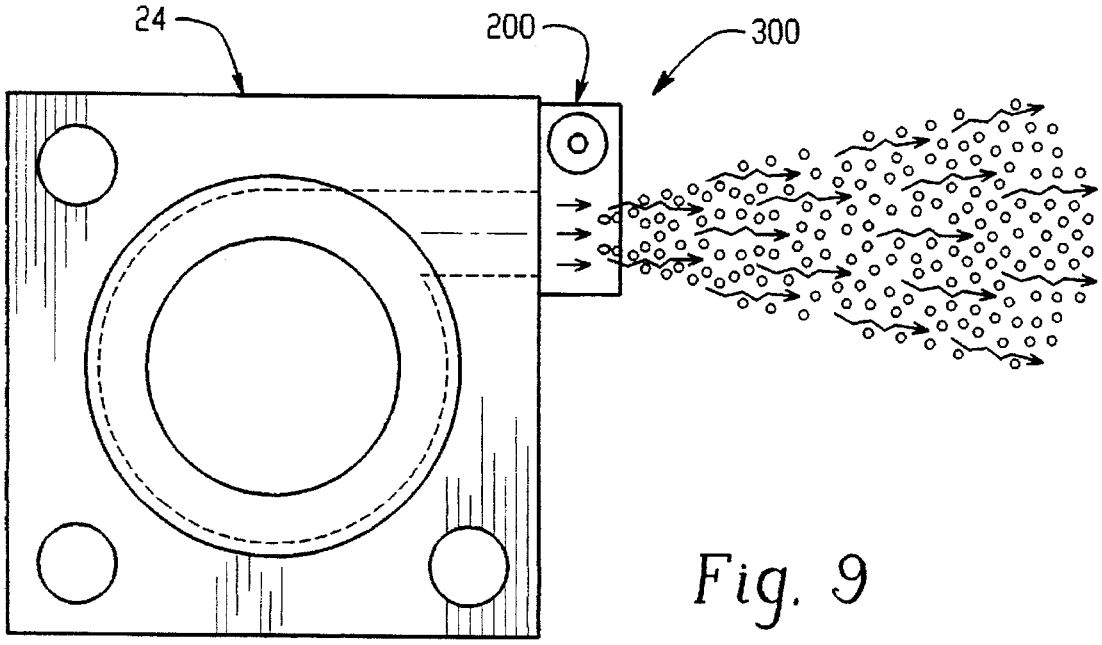
FIG. 9 is a top view of the embodiment shown in FIGS. 5 and 6 illustrating gas being released into a molten metal stream.

Two bores 314 are formed in surface 304 and extend through block 302 to communicate with passageway 308. Bores 314 are preferably cylindrical, 1/16" to ⅜" in diameter, and are formed at a 0°–60°, and most preferably a 45% downstream angle with surface 304. The term downstream refers to that portion of the molten metal stream that has exited outlet port 30 and has passed gas-release device 300 and a 0° downstream angle means that the bore has no downstream angle. In other words, a 0° downstream angle means that the bore(s) is formed perpendicular to the flow of the molten metal stream and releases gas straight up into the steam. A 90° downstream angle, therefore, describes a bore(s) formed in a direction parallel to the direction the stream flows and that releases gas in the direction that the stream flows. The 45° downstream angle of bores 314 is best seen in FIG. 8. The invention, however, is not limited to this particular arrangement. Any number of bores, any size bore(s), or any angle(s) could be chosen without departing from the teachings of this embodiment, which is to introduce gas into the lower portion of a pumped molten metal stream. In this regard, it is contemplated that many small bores, potentially having diameters smaller than 1/16", and potentially staggered on surface 304, could be used. Additionally, bores 314 could be covered with a porous material such as a ceramic through which the gas escapes. Further, gas-release device 300 may include a number of porous plugs imbedded therein, the plugs taking the place of bores 314, the gas thereby escaping through the porous plugs. Further, gas could be released from bores or openings in the sides of gas-release device 300, as long as the openings are positioned such that the gas enters the lower portion of the molten metal stream.

Figure 5:
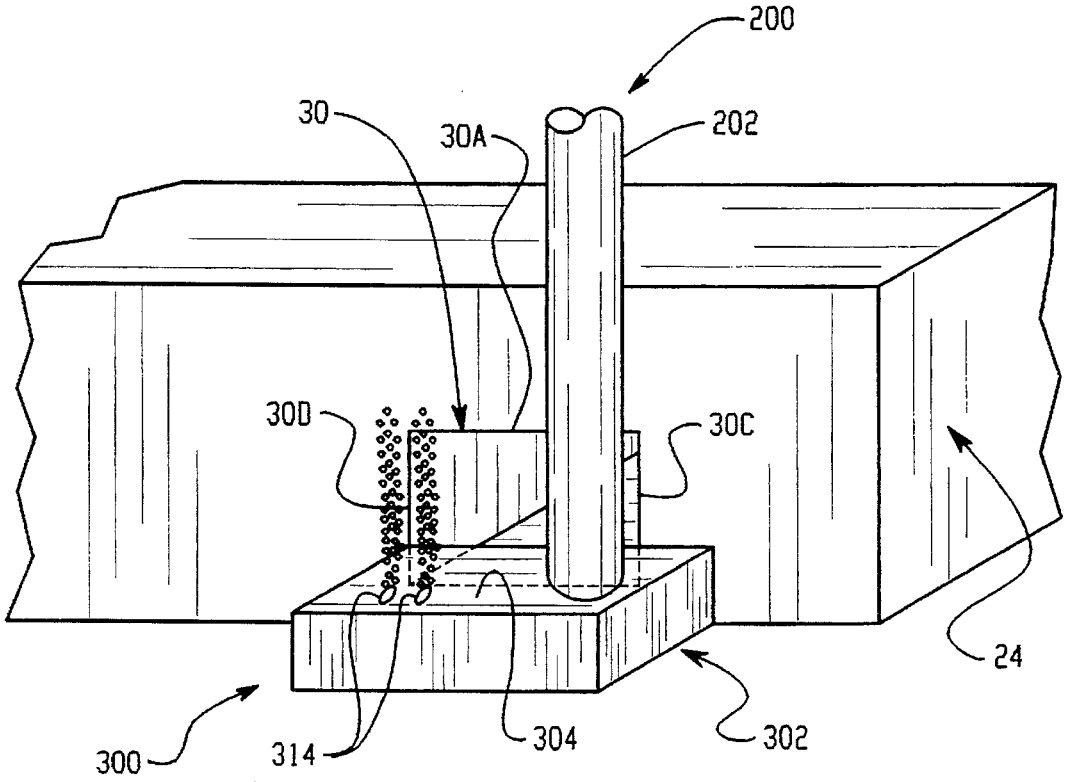
FIG. 5 is a perspective view of an alternate embodiment of the present invention which includes a gas-transfer device and a gas-release device.
Figure 6:
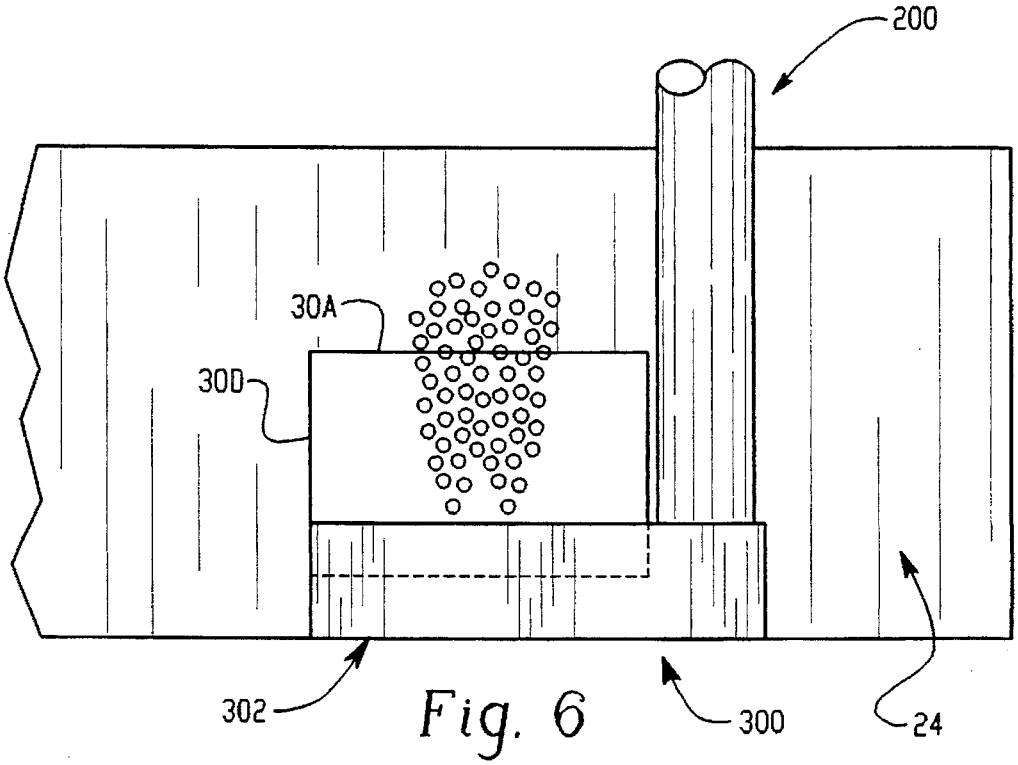
FIG. 6 is a front view of the embodiment shown in FIG. 5.
Figure 7:
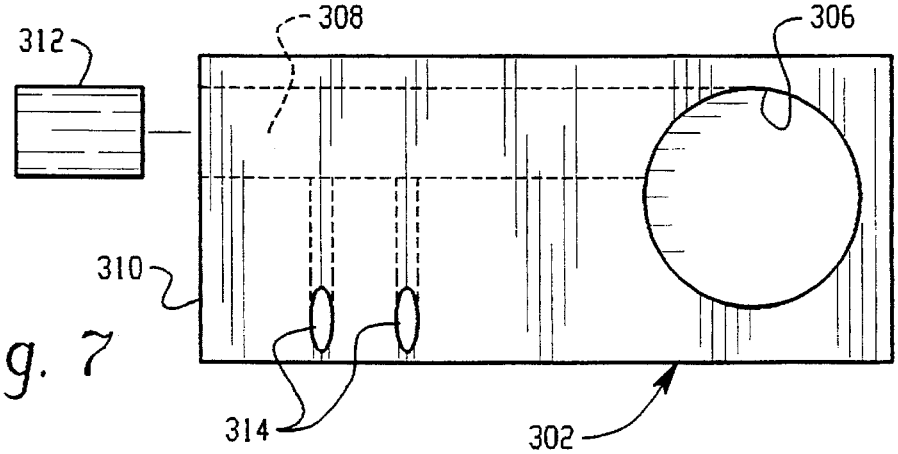
FIG. 7 is a top view of the gas-release device shown in FIGS. 5 and 6.

In this embodiment, gas-transfer device 200 is preferably positioned adjacent side 30C or 30D of outlet port 30 so that it does not interfere with the molten metal stream exiting outlet port 30, as best seen in FIG. 6. The term adjacent again meaning that the gas-transfer device is preferably positioned up to 1" within space P from either plane P2 or P3, and most preferably is flush with plane P2 or P3 so that it does not enter space P. Gas-release device 300 is preferably positioned near the bottom 30B of outlet port 30 and can be below plane P4 or ½" to 1" inside of space P as measured from plane P4, which is best seen in FIGS. 5 and 6, but device 300 is most preferably flush with bottom 30B and plane P4. All of the above mentioned preferred and most preferred positions of gas-release device 300 will collectively be referred to as adjacent the bottom of the outlet port when used in relation to a gas-release device positioned below the center of the outlet port, this center being represented in the drawings by axis A. Depending upon the size of outlet port 30, it is feasible that device 300, or any device described herein for releasing gas into the lower portion of a molten metal stream, could extend further than 1" into space P from plane P4 and still function properly without significantly disrupting the flow. The same is true for a gas-release device extending into space P from either side plane P2 or P3 or the top plane P1. If gas-release device 300 or any gas-release device described herein is positioned so as to block the outlet port and restrict the flow of molten metal, the outlet port, for the purpose of defining the relative center, center axis A, top, bottom and sides, would be the restricted opening through which the molten metal stream travels. Further, if the outlet port is blocked as described above, the restricted opening will be used to define the positions of the lower, upper and side portions of the stream.

Further, because gas-release device 300 is positioned in the lower portion of the molten metal stream it could be positioned as far as 6" from outlet port 30 and still fall within the preferred embodiment of the invention. It is most preferred, however, that gas-release device 300 be positioned 0 to 2" from outlet port 30.

The same positioning as described above, with respect to bottom 30B, plane P4, space P and outlet port 30, is preferred for all embodiments hereinafter described wherein the gas-release device is positioned below the center of the outlet port.

In operation, threads 208 of end 206 are received in bore 306 to connect gas-transfer device 200 to block 302, although any method of connecting gas-transfer device 200 to gas-release device 300 may be used. Plug 312 is threadingly received in the outer end of passageway 308 to create a gas-tight seal. Pump 20 creates a molten metal stream exiting outlet port 30 and passing over the gas-release device 300. Gas, such as chlorine gas, is introduced into first open end 202 of gas-transfer device 200. The gas travels through cavity 204, out of open end 206 and passes into bore 306 and travels through passageway 308. The gas then escapes through bores 314, effusing into the molten metal stream above. In a preferred embodiment, with bores 314 formed at a 0°–60°, and most preferably a 45 downstream angle to surface 304, the angled bores direct the escaping gas towards the flow of the molten metal stream so that the gas better merges with the molten metal. The bores, however, do not have to be angled but, the dispersion of gas within the molten metal is better when the gas is released at a 0°–60° angle.

Alternatively, instead of providing a separate gas-release device and gas-transfer device, the gas-release device could be integrally formed with the gas-transfer device. For example, a hollow graphite tube formed at an angle so that a section of the tube extended under the molten metal stream could be used, it being understood that all such one-piece embodiments are encompassed by the scope of the present invention. Furthermore, the gas-release device could be connected to, or integrally formed with, pump base 24 and/or outlet port 30. Additionally, the gas-release device may be positioned so as to release gas inside of and near, or at, opening O of outlet port 30.

Figure 11:
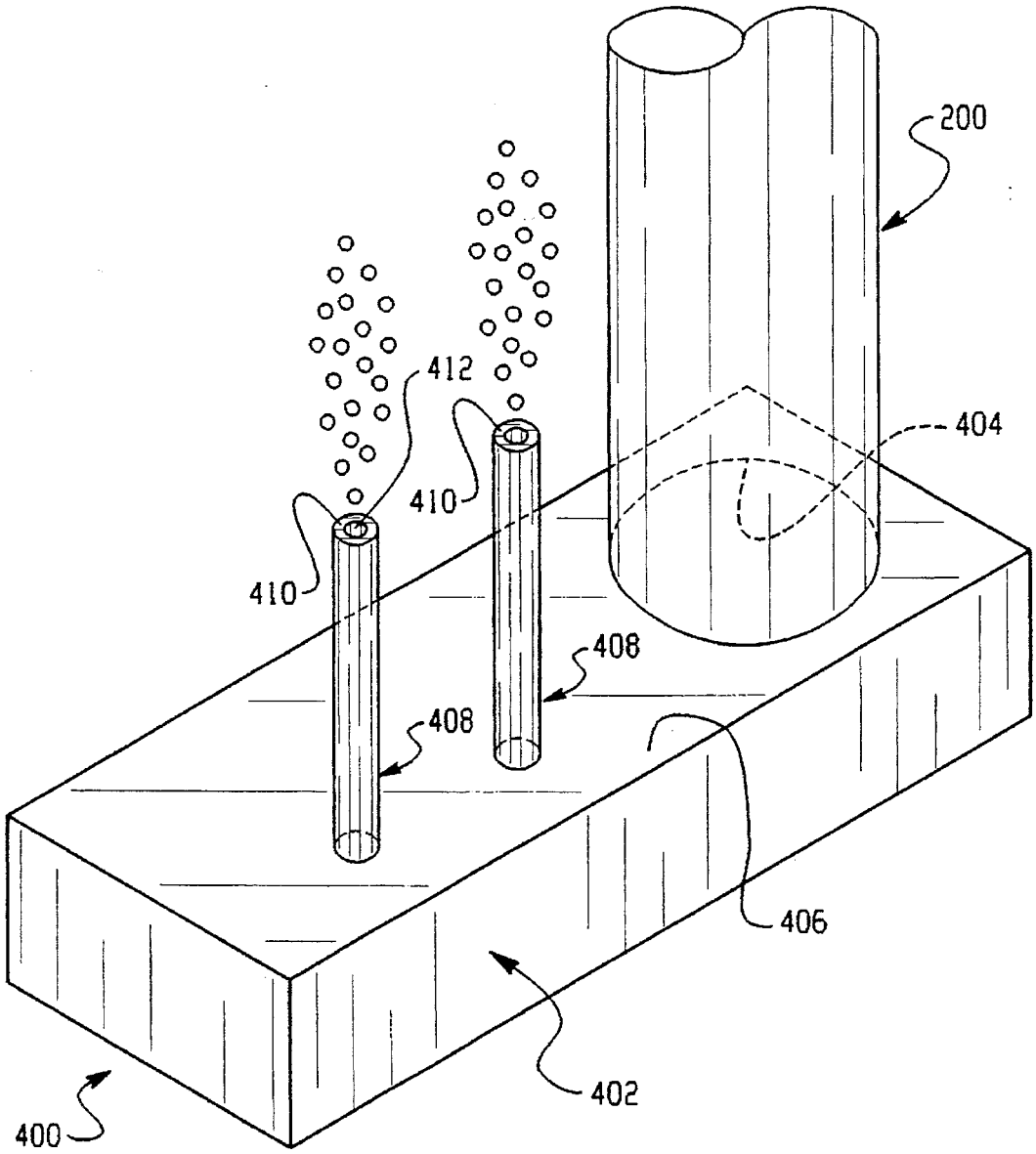
FIG. 11 is a perspective view of an alternate embodiment of a gas-release device according to the present invention that includes hollow tubes that extend into a molten metal stream exiting the outlet port.

An alternate gas-release device 400 is shown in FIG. 11 having a gas-release block 402. Block 402 is preferably formed of the same material and is preferably of the same size and shape as previously described block 302, it again being understood that any size or shape structure or any material capable of functioning in a molten metal environment will suffice. Block 402 has inlet port 404, which connects to previously-described gas-transfer device 200. A passageway (not shown) is formed in block 402 preferably in the same manner and having the same dimension, and is plugged in the same manner, as is passageway 308 in block 302. It will be understood that the passageway may be formed through any side(s) of blocks 302, 402 and may be formed at an angle within either block 302, 402.

Bores (not shown) are again formed, preferably by drilling, in a top surface 406 of block 402. Upwardly extending tubes 408 are inserted in, or attached to, the bores, gas thereby escaping through openings 412 in outer ends 410 of tubes 408. Tubes 408 preferably extend outward at a 0°–60° downstream angle from surface 406 and preferably extend 1" outward as measured along tube 408 from surface 406. Tubes 408 preferably have an outer diameter of ¼" to 1" and an inner diameter of 1/16" to ½". Openings 412 preferably are circular and have a diameter equal to the inside diameter of tubes 408. In the embodiment shown, there are two tubes 408 however, only one tube, or more than two tubes could be used. Furthermore, the specific dimensions of tubes 408 and openings 412 and the number, length and positioning of tubes 408 are not critical to the teachings of the invention. Tubes 408 could be staggered in height and could be arranged in any manner on block 402 thereby not necessarily being in the side-to-side arrangement shown. Finally, openings 412 could contain covers of porous material such as those described above or tubes 408 could each contain an inset of porous material or be completely or partially formed of porous material.

It will be understood that if tubes 408 extend into the molten metal stream from the lower portion and/or one or both side portions, even though a low pressure area may be formed behind the tube(s), gas released from the tube will rise and will not enter the low pressure area. Therefore, in all embodiments of the invention described herein that include gas-release tube(s) extending into the lower portion or one or both side portions of the molten metal stream, the diameter of the tube could be relatively wide because it is unlikely that the dispersion of gas within the molten metal will be effected by the low pressure zone behind the tube(s).

Figure 12:
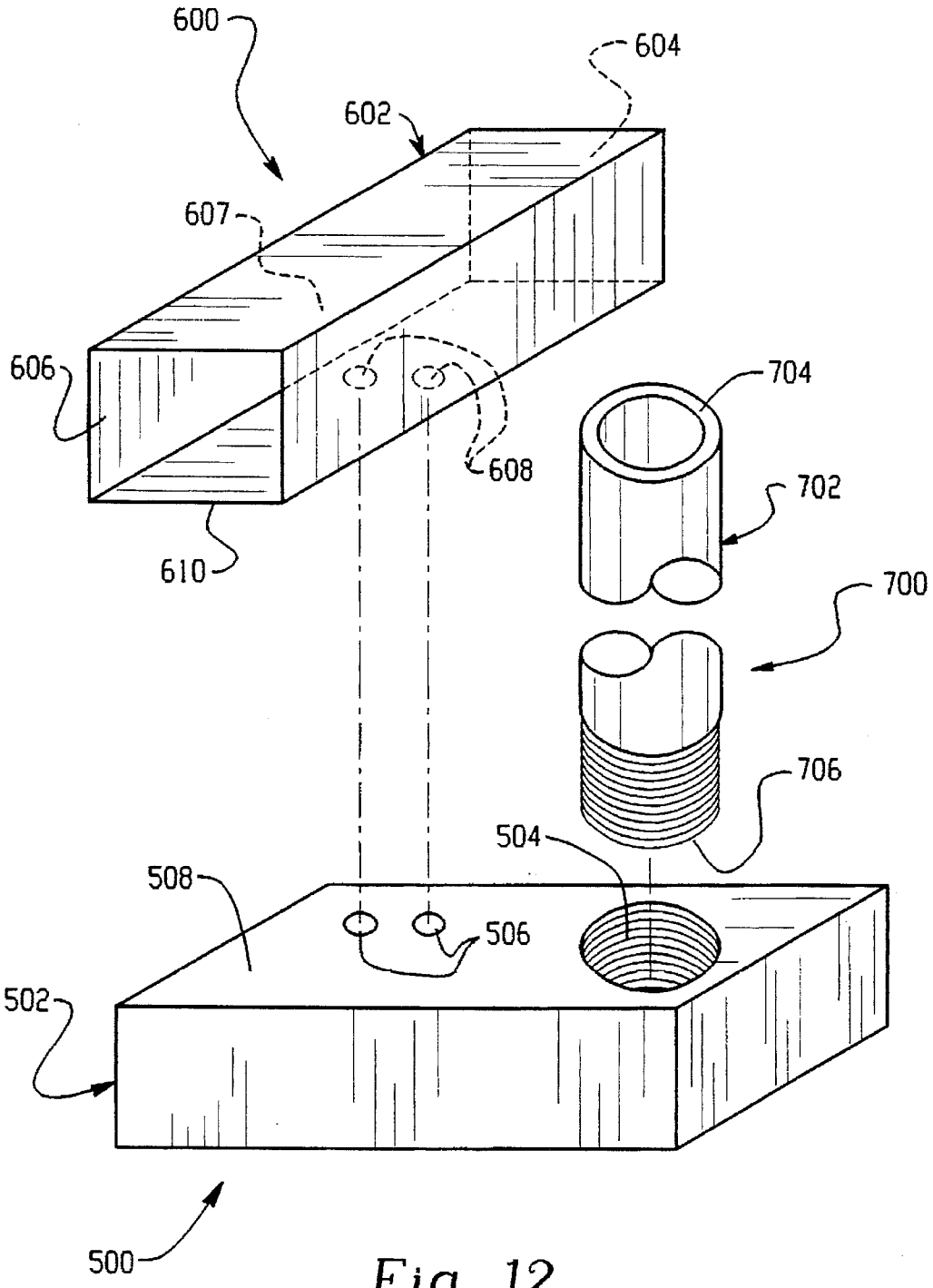
FIG. 12 is an exploded perspective view of a system and device including a gas-release device that releases gas into a channel defined by a metal-transfer device.
Figure 13:
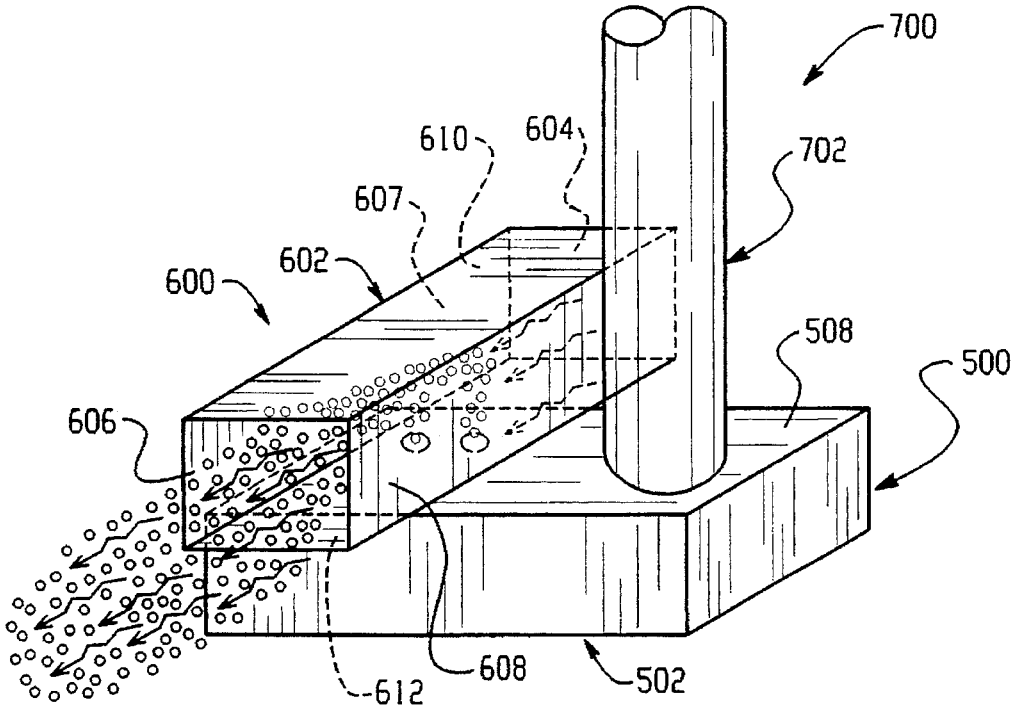
FIG. 13 is a perspective view of the system and device shown in FIG. 12.

Another embodiment of the invention is shown in FIGS. 12–13 wherein a system and device including gas-release device for releasing gas into a metal-transfer device is shown. As used herein, the term metal-transfer device refers to any totally enclosed or partially enclosed structure which can, at least partially, contain a molten metal stream or flow. The enclosed portion of the metal-transfer device which contains the molten metal flow is hereinafter referred to as a channel.

Some preferred shapes of a metal-transfer device of the present invention are semi-circular, U-shaped, V-shaped, circular, rectangular, square or 3-sided with an open bottom. It will be understood that, if the metal-transfer device is open on one side, for example, if the metal-transfer device is U-shaped, semi-circular, V-shaped or 3-sided, the open side faces downward. Furthermore, the metal-transfer device may include baffles that break the molten metal stream into two or more separate streams traveling through two or more channels defined within the metal-transfer device. The most preferred metal-transfer device of the present invention is a fully enclosed square or rectangular conduit having a length of 12"–48", and most preferably 12"–18", although a length of less than 12", but preferably not less than 4", could be used. The metal-transfer device may be attached to the outlet port of a pump device or be formed as part of a pump base or be a separate structure from the pump base and not be attached to, but instead simply be positioned so that the channel can communicate with, the outlet port. If the metal-transfer device is formed as part of the pump base, the device preferably defines a channel extending outward from pump chamber 26. The term communicate, when used in this context, means that at least part of the pumped molten metal stream exiting the outlet port enters the channel defined by the metal-transfer device. Utilizing the gas-release structures described previously in this disclosure, and other structures of which preferred embodiments will hereinafter be described, the dispersion of gas within a molten metal stream confined by a metal-transfer device can be greatly enhanced thereby greatly improving the efficiency of demagging or degassing aluminum.

As shown in FIGS. 12 and 13, a preferred system and device for releasing gas into the bottom portion of a channel defined by a metal-transfer device is shown. As used herein, the term bottom portion refers to any position below the center of the channel. Further, the channel also includes a top portion, which comprises all positions above the center of the channel and two side portions, one formed on either side of the center of the channel. If the channel is completely blocked by a gas-release device or any other structure so as to restrict the flow of molten metal through an opening smaller than the channel, the channel at that position will be defined as the restricted opening. The center, bottom portion, top portion and side portions of the channel will be determined in relation to the restricted opening at that position.

FIG. 12 shows a gas-release device 500, a metal-transfer device 600 and a gas-transfer device 700. Gas-release device 500 is preferably comprised of a gas-release block 502, which is generally made from the same materials and has the same dimensions as previously described gas-release block 302. The present invention is not, however, limited to a particular structure for releasing gas into a portion of a channel defined by a metal-transfer device.

Bores, or openings, 506 are formed in an upper surface 508 and are preferably cylindrical and 1/16" to 3/8" in diameter although any size or shape bore(s) could be used. Further, only one bore, or more than two bores, could optionally be used, and any arrangement or positioning of the bores on surface 508 would also fall within the scope of the invention. Additionally, porous covers or plugs or insets, such as those described previously, could be used in conjunction with, or in place of, bores 506. Bores 506 are positioned on surface 508, and are of such size and shape that they can be aligned with and communicate with, apertures 608 in metal-transfer conduit 602. The term communicate, when used in this context, means that gas escaping from the gas-release bores or openings enters the channel defined by the metal-transfer device. Block 502 has a threaded inlet bore 504. A passageway (not shown) is formed in the same manner and preferably has the same dimensions and is plugged in the same manner as previously described passageway 308. Bore 504 and bores 506 communicate with the passageway.

Metal-transfer device 600 is preferably a rectangular conduit 602 having a first open end 604 and a second open end 606 conduit 602 defines a channel 607. Conduit 602 is preferably made from graphite impregnated with an oxidation-resistant solution, although other materials could be used. End 604 is preferably connected to, or integrally formed with, the outlet port (not shown) of the pump base (not shown), although metal-transfer device 600 may simply communicate with the outlet port or be formed as part of the pump base, as previously mentioned. Apertures 608 are formed in a bottom wall 610 of conduit 602 and are of a size and shape and are positioned such that they can align with and communicate with bores 506 in gas-release block 502.

Gas-transfer device 700 preferably comprises a gas-transfer tube 702, which is preferably made from the same material and has the same general overall dimensions as previously described gas-transfer device 200, although other structures may be used. Tube 702 is, therefore, hollow and has a first end 704, connectable to a gas source. A second end 706, which preferably has a threaded outer surface, is formed opposite end 704.

As shown in FIG. 13, gas-release device 500 is positioned beneath, and may be connected to, metal-transfer device 600 so that ports 506 align and communicate with apertures 608. It is most preferred, however, that an opening (not shown) be formed in a side 608 so that gas-release device 500 may be inserted therein and be received in cavity 607; gas-release device 500 preferably resting on the inner surface of lower wall 612. It is also preferred than an opening (not shown) be formed in a side wall 610 so that gas-release device 500 can be inserted partially through the opening in wall 610 thereby extending partially through both the opening in wall 608 and the opening in wall 610 with the majority of device 500 being retained in channel 607 of metal-transfer device 600. This positioning is illustrated and further described in relation to a gas-release device 900, described herein.

End 706 of gas-transfer device 700 is threadingly received in bore 504, although other means of attachment may be used.

In operation, a pump (not shown) pumps a molten metal stream which exits an outlet port (not shown) and travels through channel 607 of metal-transfer conduit 602, moving from end 604 to end 606. A gas source provides gas to end 704 of gas-transfer device 700, the gas traveling through tube 702 and exiting end 706 and passing into bore 504 and into the passageway (not shown) of block 502. The gas then escapes through ports 506 and passes through openings 608 to enter the bottom of channel 607 where it enters the molten metal stream being pumped through channel 607 of metal-transfer conduit 602.

Gas-release device 500 need not necessarily be connected to metal-transfer device 600, although this is the preferred embodiment. Gas-release device 500 may be independently held in position next to metal-transfer device 600, for example, by attachment to the pump base or to gas-transfer device 700, so that bores 506 align with and communicate with apertures 608 and channel 607.

Figure 14:
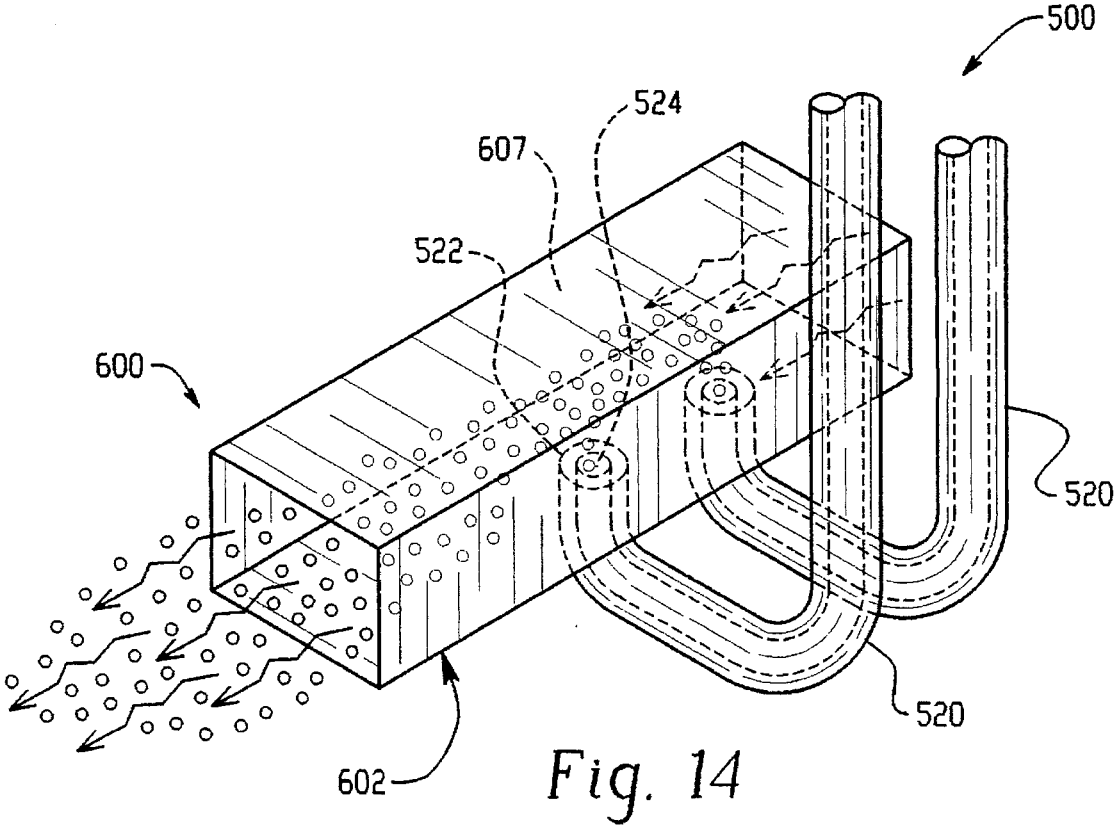
FIG. 14 is an alternate embodiment showing another system and device for releasing gas into a channel defined by a metal-transfer device.

Turning now to FIG. 14, an alternate embodiment of a system and device for releasing gas into a channel defined by a metal-transfer device 600 is shown. In this embodiment, gas-release device 500 comprises one or more angled hollow tubes 520, tubes 520 preferably being made of the same material and preferably being of the same general dimensions as previously described tube 102. Each tube 520 is either comprised of a one-piece tubular section formed at an angle, or is a multi-piece member formed by cementing together or otherwise joining more than one tubular section.

Metal-transfer device 600 is again preferably a conduit 602, as previously described. Each tube 520 has an end 522 that is either connected to or butts against the outer surface of bottom wall 610. End 522 has a generally circular opening, or bore, 524, which is preferably 1/16" to 3/8" in diameter, although any size or shape opening could be used. Further, each opening 524 could have a porous plug or cover or inset as previously described, or the entire end 522 of tube 520 could be formed of a porous material. Each opening 524 aligns with and communicates with an aperture 608 formed in bottom wall 610 of metal-transfer conduit 602. In the embodiment shown there are two tubes 520 arranged in series, the term series meaning that the tubes are linearly oriented along the longitudinal axis of metal-transfer device 600. The invention may also comprise just one, or more than two, tubes 520 and tubes 520 may positioned in any manner, so long as they release gas into the bottom of channel 607. Additionally, apertures 608 may be large enough to receive tubes 520 so that 520 extend through wall 610 into channel 607, or so that ends 522 are flush with the inside surface of wall 610.

Figure 15:
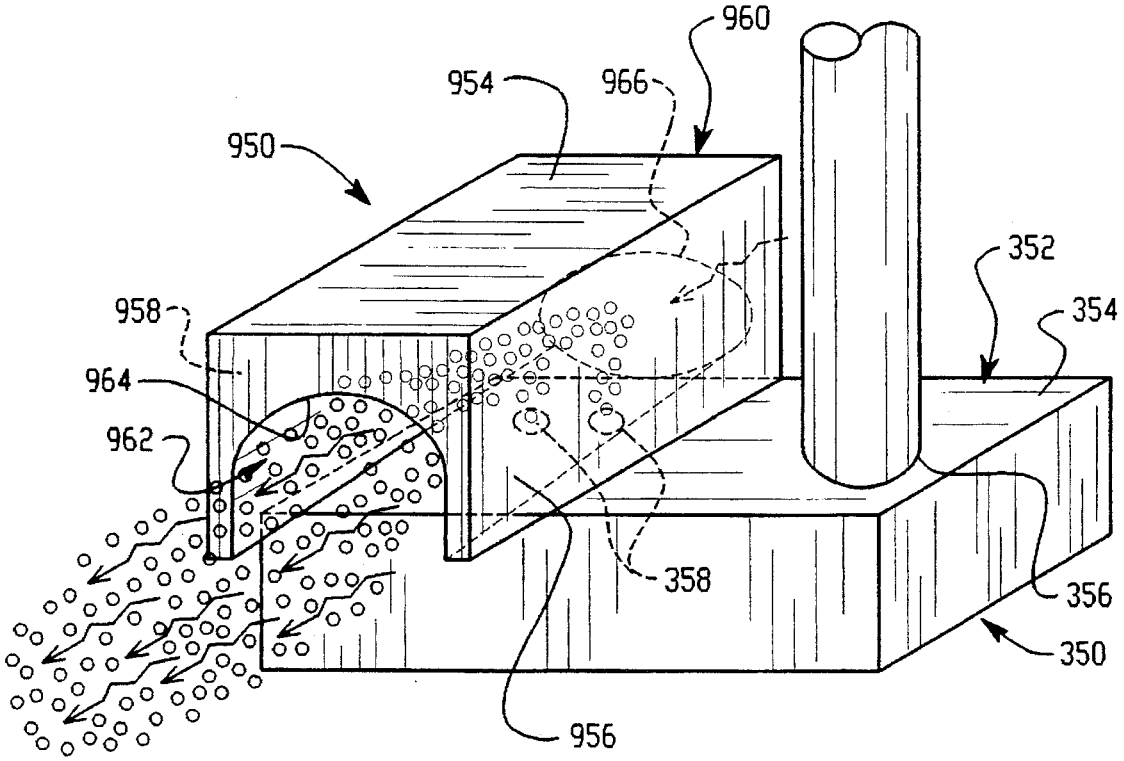
FIG. 15 is a perspective view of another embodiment for releasing gas into a channel defined by a metal-transfer device.

Turning now to FIG. 15, another embodiment of the invention is shown for releasing gas into a channel defined by a metal-transfer device. A metal-transfer device 950, a gas-release device 350 and previously described gas-transfer device 200 are provided. Metal-transfer device 950 preferably has an upper wall 954, side walls 956, 958, a first end 960 and a second end 962. A generally U-shaped channel 964 is formed within metal-transfer device 950. First end 960 has an opening 966 that communicates with and preferably is connected to the outlet port (not shown) of a pump (not shown). In the embodiment shown, opening 966 is generally oval, although other shapes could be used, and communicates with channel 964.

A gas-release device 350 is provided that is preferably a gas release block 352, which preferably has the same structure as previously described gas-release block 302, although any structure capable of releasing gas into the bottom portion of a channel defined by a metal-transfer device would suffice. Gas-release block 352 has a top surface 354. A gas-inlet bore, or opening, 356 is formed in surface 354, is preferably 1½" in diameter and is threaded to receive a threaded end of gas-transfer device 200, although other means of attachment could be used. Gas-release bores, or openings, 358 are formed in surface 354 at preferably a 0°–60°, and most preferably, a 45° downstream angle. In the embodiment shown, there are two gas-release bores 354, which are preferably circular and 1/16" to 3/8" in diameter. Any size or shape bore, however, could be used. Further, there could be only one, or more than two, bores 358.

Metal-transfer device 950 is preferably positioned above the gas-release device so that the two side walls 956, 958 rest on top surface 354 of the gas-release device. Metal-transfer device 950 and gas-release device 350, positioned in this manner, form a totally enclosed metal-transfer conduit with the top surface 354 of gas-release device 350 forming the bottom surface of the metal-transfer conduit. It is not necessary, however, that metal-transfer device 950 physically contact gas-release device 350. The invention would still function as long as the molten metal stream is confined by channel 964 and gas is released into the bottom portion of channel 964 by gas-release device 350. Furthermore, metal-transfer device 950 may be any practically sized or shaped structure, such as those previously described.

Figure 16:
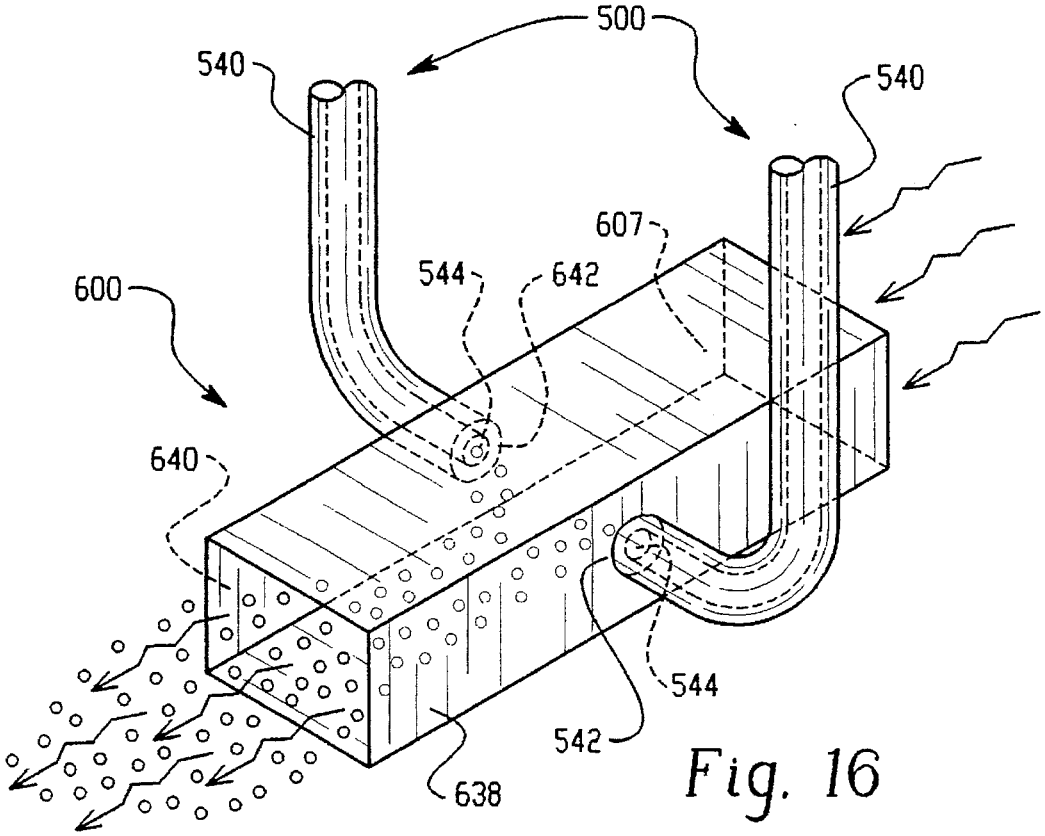
FIG. 16 is an alternate embodiment of the invention showing a system and device for releasing gas into a channel defined by a metal-transfer device.
Figure 17:
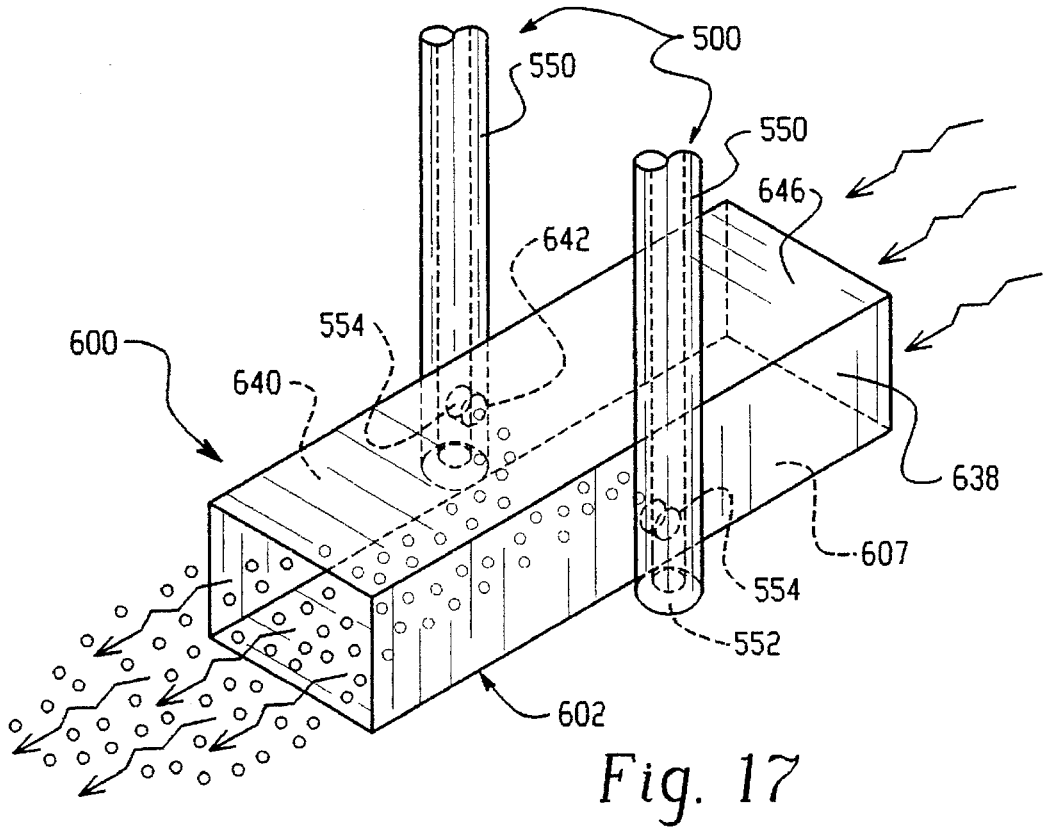
FIG. 17 is an alternate embodiment for releasing gas into a channel defined by a metal-transfer device.

Turning now to FIGS. 16–17 alternative embodiments are shown for releasing gas into the side portions of a channel defined by a metal-transfer device 600. In the embodiment shown in FIG. 16, metal-transfer device 600 defines a channel 607 and has sides 638 and 640, with an aperture 642 formed in each side 638, 640. Gas-release device 500 preferably comprises two gas-release tubes 540, each gas-release tube 540 preferably being formed at a right angle and having an end 542 that is connected to, or butts against, one of the sides 638, 640. It will be appreciated, however, that the invention is not limited to a gas-release device having this structure, any structure that could release gas into one or both side portions of a channel defined by a metal-transfer device could be used. Further, apertures 642 may be large enough for tubes 540 to be inserted therein and ends 542 could either be flush with the inner surfaces of walls 638, 640 or could extend into channel 607.

Gas-release tubes 540 generally have the same dimensions and are constructed in the same manner as gas-release tubes 520, although gas-release tubes 540 are shaped differently than tubes 520, as illustrated in the drawings. An opening, or bore, 544 is formed at each end 542, opening 544 aligning with and communicating with an aperture 642 in either side 638 or 640, as shown. Openings 544 are preferably circular and 1/16" to 3/8" in diameter although any shape or dimension of opening could be used. Furthermore, only one tube 540 may be positioned against one side, either 638 or 640, of metal-transfer conduit 602, or a plurality of tubes 540 may be positioned against one side either 638 or 640, or more than one tube 540 may be positioned against both sides 638, 640, wherein each tube 540 has an opening or openings 544 that aligns with apertures 642 in conduit 602 so as to communicate with channel 607.

Alternatively, as shown in FIG. 17, gas-release device 500 may comprise straight gas-release tubes 550, each tube 550 having a closed end 552 and an aperture, or bore, 554 preferably formed in the cylindrical body of tube 550 above end 552. Apertures 554 align with and communicate with apertures 642 in sides 638 and 640. Tubes 550 are preferably formed of the same general material and has the same dimensions as previously described tube 102, although other materials and/or other dimensions could be used. Further, only one, or more than two, tubes 550 could be used and each individual tube may have more than one opening 554 that communicates with channel 607. Tubes 520 may be partially recessed into side 638 and/or side 640 and may even extend through upper wall 646 along the inside surface of either wall 638, or 640 or both walls 638, 640.

Openings 554 and apertures 642 are preferably 1/16" to 3/8" in diameter, however, any size or shape apertures could be used. Furthermore, in addition to the embodiments shown, there may be only one gas-release device 500 located on one side of metal-transfer device 600 or a plurality of gas-release device 500 located on one or both sides of the metal-transfer device 600. Additionally, the embodiments shown in FIGS. 16–17 could include porous covers or plugs over openings 544 and/or aperture 642 and aperture 554. Further, porous insets could be positioned within either apertures 642 or openings 554 or be formed as part of gas-release device 500 or metal-transfer device 600, as long as the gas can effuse through the porous material into channel 607.

Figure 18:
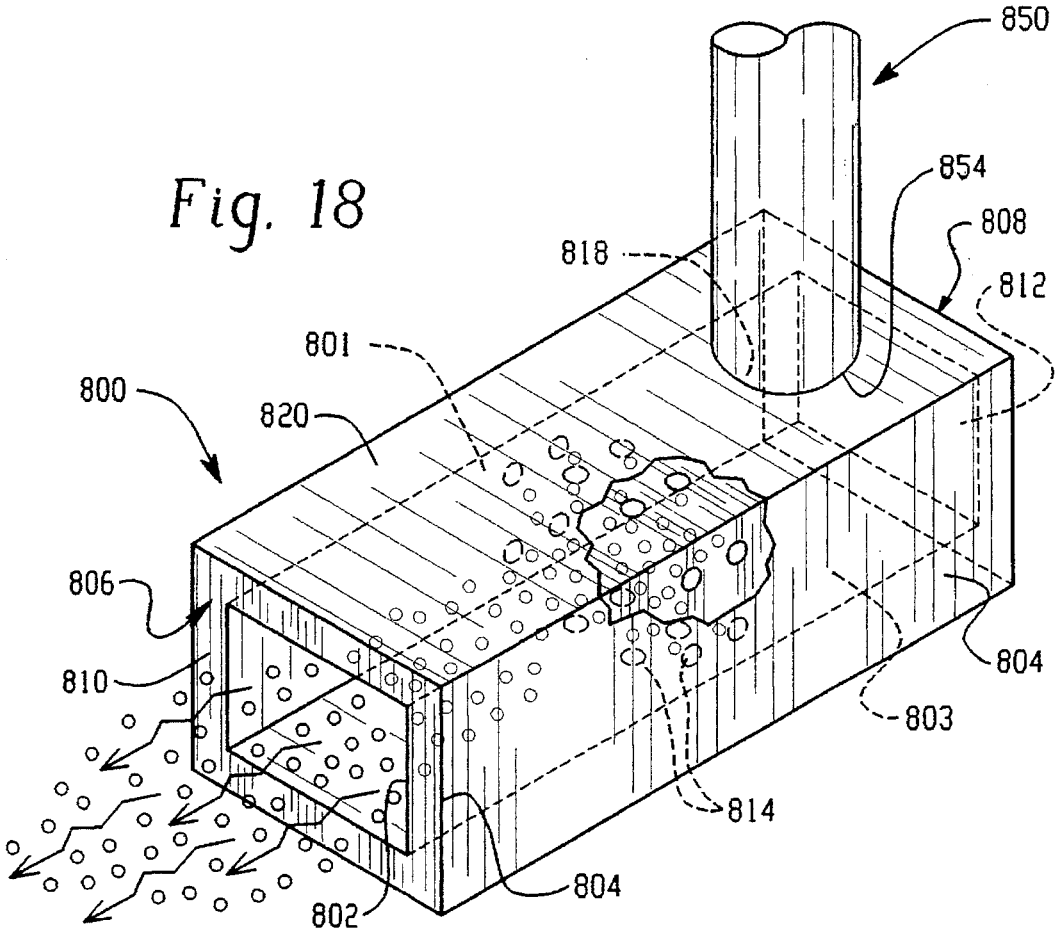
FIG. 18 is an alternate embodiment of the invention wherein the metal-transfer device has a hollow wall and gas is released into the hollow wall and escapes through openings in an inner wall to enter a channel defined by the inner wall.

An alternate embodiment of the present invention is shown in FIG. 18. Metal-transfer device 800 is shown that has an inner wall 802 and an outer wall 804. Device 800 is preferably formed of graphite impregnated with an oxidation-resistant solution, although other materials may be used. Walls 802 and 804 each define a generally rectangular conduit. Walls 802 and 804 are spaced apart and are joined at ends 806 and 808 by caps 810 and 812, a cavity 801 thereby being defined between walls 802, 804 and caps 810, 812. A channel 803 is defined by wall 802. End 806 is preferably connected to outlet port 30 (not shown). Caps 810 and 812 are preferably formed of the same material as walls 802, 804 and could be cemented in place or formed to walls 802, 804 by any other suitable means. Inner Wall 802 preferably has one or more apertures 814 formed in bottom wall 816. Apertures 814 are preferably circular and 1/16" to 3/8" in diameter although any dimension and any shape aperture could be used. Further, although two side-by-side apertures are shown, only one, or more than two, could be used and the apertures could be positioned in any manner. Additionally, apertures 814 could be formed in the side walls or even in the top wall of inside wall 802 in this embodiment and still fall within the scope of the invention. Outer wall 804 has an orifice 818 preferably formed in upper wall 820.

A gas-transfer device 850 is provided that is preferably a graphite tube made of the same material and having the same dimensions as previously described tube 102, although other materials and configurations could be used. Device 850 has an end (not shown) connectable to a gas source and an end 854 connectable to metal-transfer device 800. End 854 can be threadingly received in orifice 818 of outer wall 804 or cemented therein or attached by any other suitable means.

In operation a pump (not shown) pumps a molten metal stream through an outlet port (not shown) and through channel 803 of metal-transfer device 800. Gas is introduced into gas-transfer device 850 where it travels to end 854 and passes through opening 818 into cavity 801 defined between walls 802, 804 and caps 810, 812. The gas then escapes through apertures 814 into the molten metal stream being pumped through channel 803 of metal-transfer device 800. It will be understood that cavity 801 need not extend about all four sides of metal-transfer device 800. For example, outer wall 804 may only extend about three sides or two sides, or only one side of the conduit defined by inner wall 802. Furthermore, outer wall 804 need not extend along the entire length of inner wall 802. The inventive concept in this embodiment thus being a metal-transfer device having an inner and an outer wall and a cavity formed therebetween, whereby gas can enter the cavity and be released into the molten metal stream through apertures in the inner wall.

Figure 19:
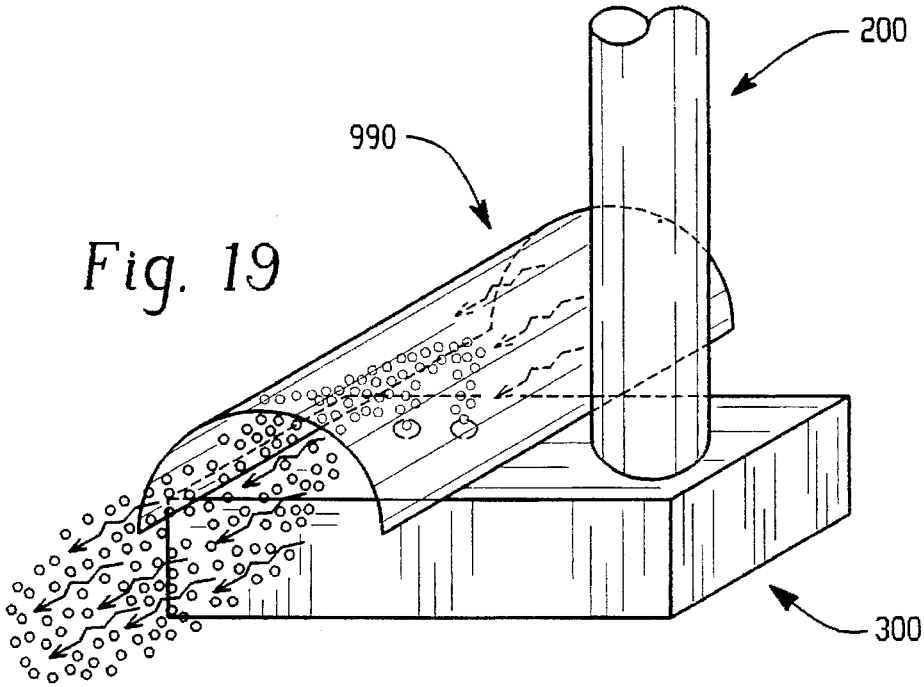
FIG. 19 is an alternate embodiment of the invention showing a semi-circular metal-transfer device.
Figure 20:
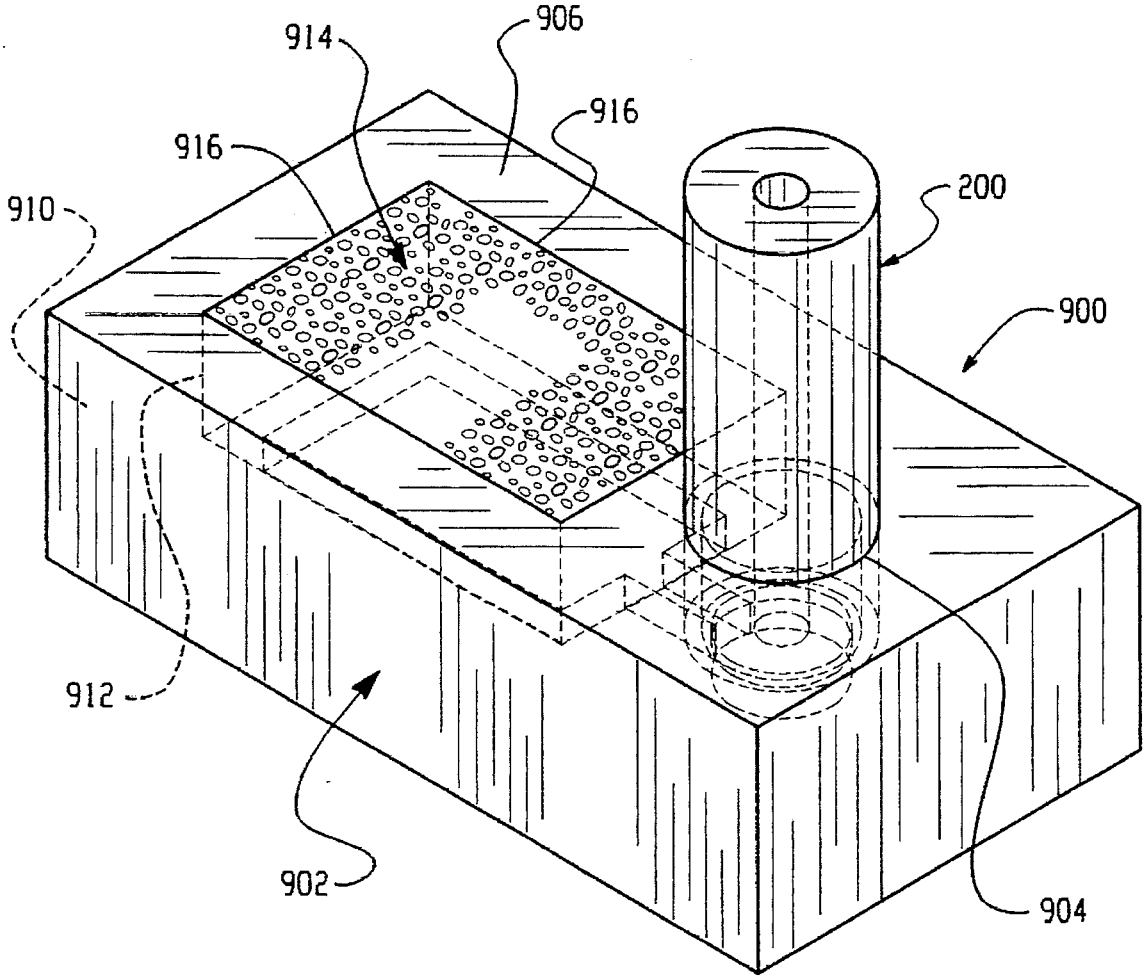
FIG. 20 is a perspective view of another embodiment of the invention showing a gas-release device having a porous block.
Figure 21:
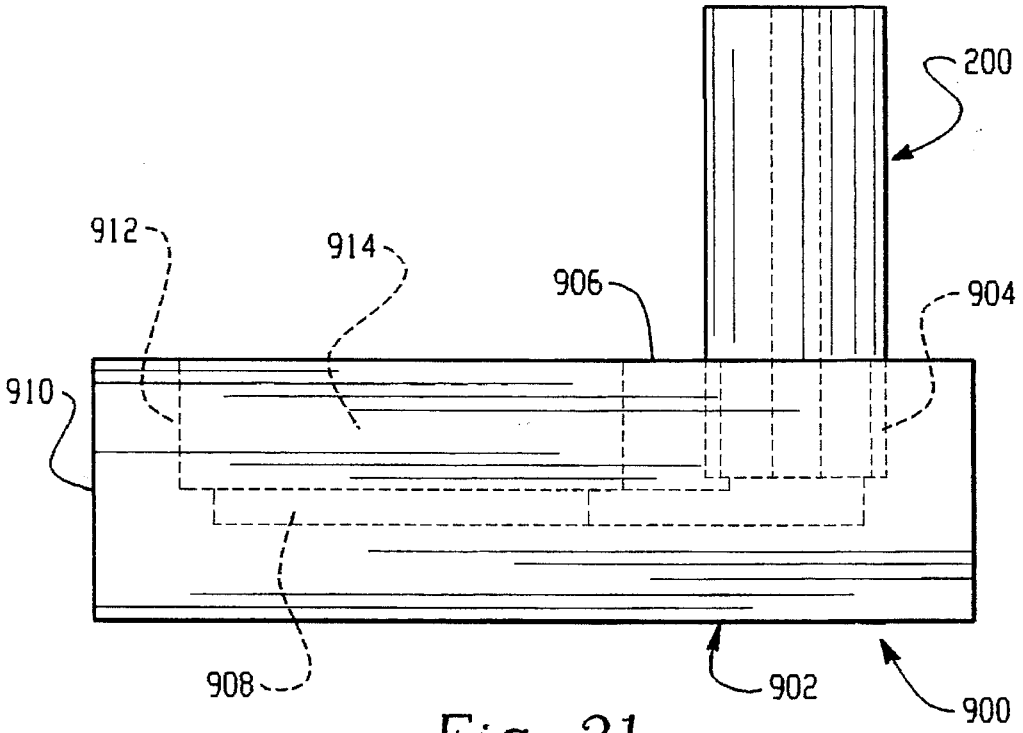
FIG. 21 is a side view of the gas-release device shown in FIG. 20.
Figure 22:
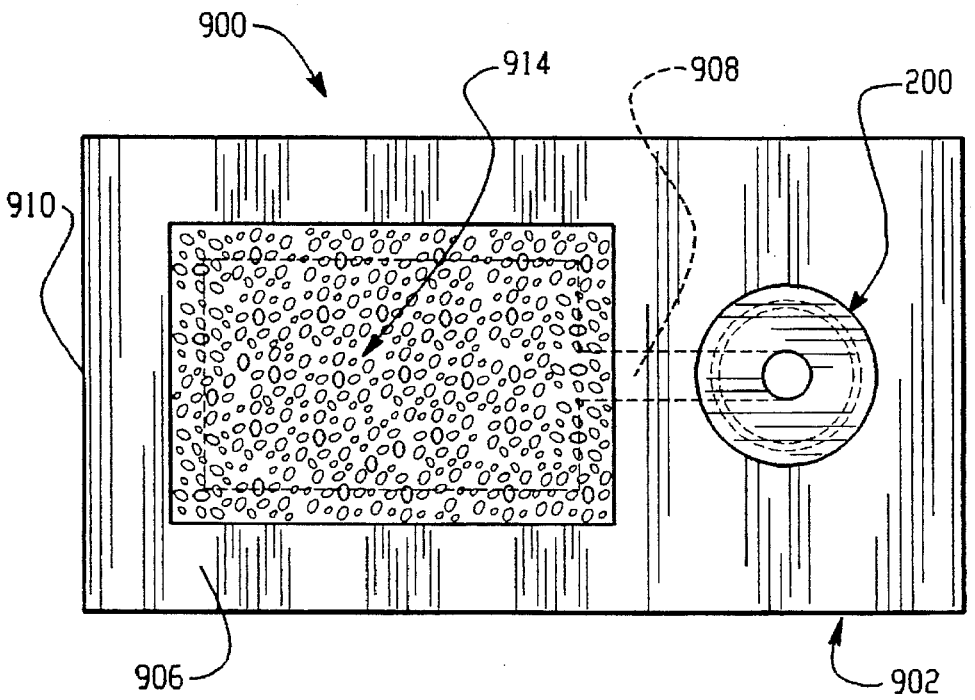
FIG. 22 is a top view of the gas-release device shown in FIG. 20.

Turning now to FIG. 19, an alternate embodiment is shown having a semi-circular metal-transfer device 990, a gas-release device 300, as previously described, and a gas-transfer device 200, as previously described. As explained previously, metal-transfer device 900 may or may not be connected to gas-release device 300 or gas-transfer device 200 and may or may not be connected to base 24.

FIGS. 20–23 show another embodiment of the present invention having a gas-release device 900, which is preferably used in conjunction with a metal-transfer device, although it could be used without a metal-transfer device, in a similar manner as previously described gas-release device 300.

Gas-release device 900 preferably comprises a graphite block 902 comprised of the same materials and having the same overall dimensions as previously described block 302, although other materials and shapes or sizes could be used. Block 902 has a gas-inlet bore 904 formed in an upper surface 906, bore 904 extending preferably 1½" into block 902. A passageway 908 is formed in block 902, preferably extending from bore 904 into the central region of block 902. Passageway 908, if formed so that it passes through a side of block 902, is preferably plugged in the same manner as previously described passageway 308, although other structures or methods may be used. Passageway 908 communicates with bore 904 and is preferably cylindrical and has a diameter of ½", although other shapes and dimensions could be used. A chamber 912 is formed in block 902 above passageway 908. Chamber 912 communicates with passageway 908 and is preferably square or rectangular. Chamber 912 is open along surface 906 and can be formed by molding or otherwise forming a solid block 902 and then machining surface 906 using a lathe or drill or other suitable tool, or by molding or otherwise forming block 902 with chamber 912.

A porous block 914 preferably comprises ceramic or refractory material, although other materials capable of withstanding the environment of molten metal furnace, and through which gas can travel, may be used. Porous block 914 is received in chamber 912 and retained there by any suitable means such as cement or screws. Alternatively block 914 may be pressure fit into chamber 912 or held in place by an inward-extending lip (not shown) along one or more of edges 916 of chamber 912.

Figure 23:
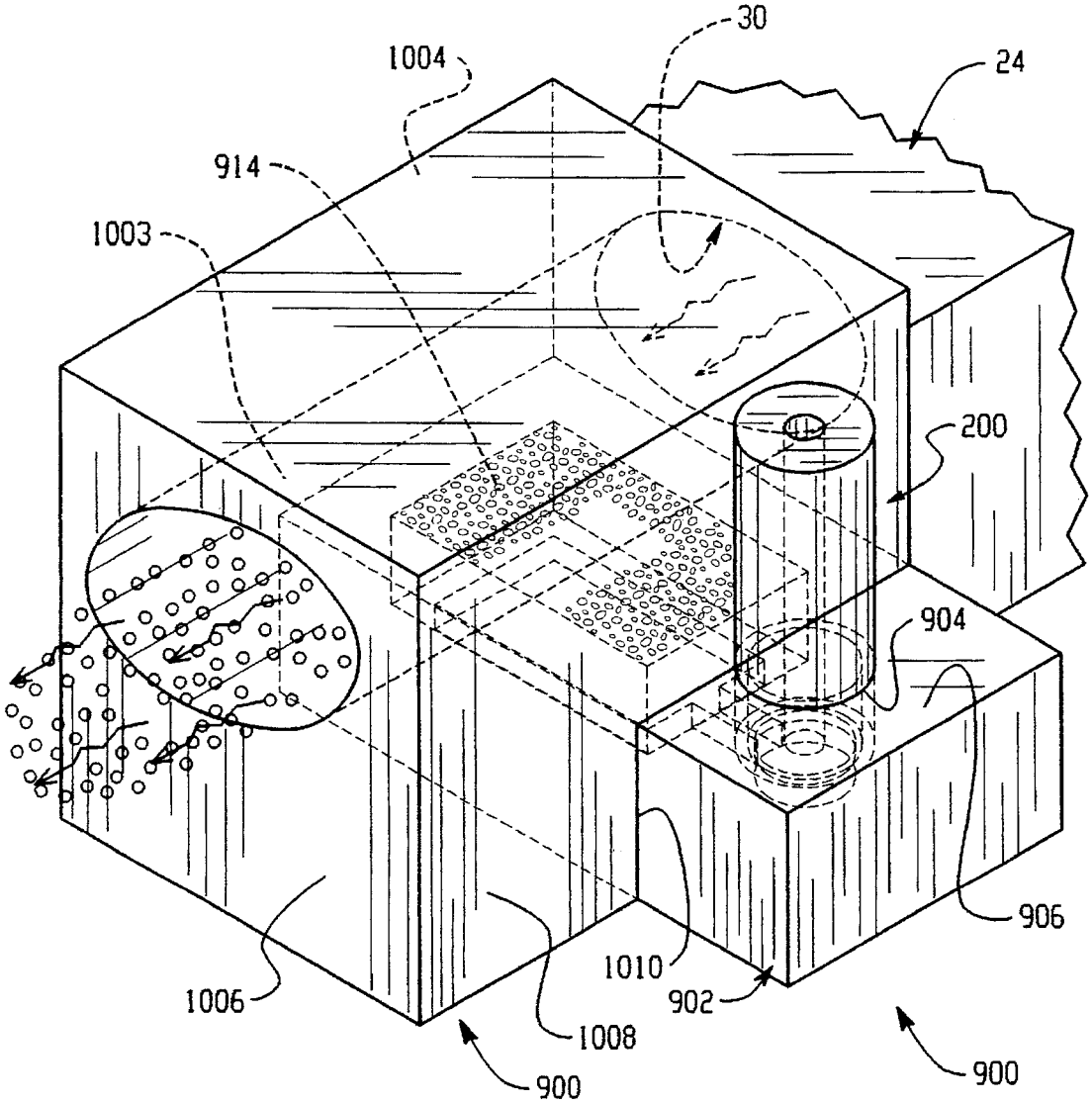
FIG. 23 is a perspective view of the gas-release device shown in FIGS. 20–22 used with a metal-transfer device, illustrating gas being released into a molten metal stream.

Metal-transfer device 1000, best seen in FIG. 23, is preferably a fully enclosed rectangular conduit 1002 defining a channel 1003, although other shapes, as previously described, may be used. A wall 1008 has an opening 1010 formed therein, opening 1010 communicates with channel 1003 and is of the proper size and shape to receive block 902, preferably in the manner and position indicated in FIG. 23. A side wall 1004 is preferably formed opposite wall 1008 and has an opening 1006 preferably dimensioned the same as opening 1010.

In operation, gas-release block 902 is inserted, or received in, opening 1010 so that at least part of porous block 914 is positioned in or communicates with channel 1003. Preferably, all or most of porous block 914 is retained within channel 1003. In the preferred embodiment, block 902 is positioned on the bottom of channel 1003, and preferably extends through opening 1006 in side 1004, as shown in FIG. 23. In this position, block 902 preferably is in contact with base 24 (not shown) and extends into space P (not shown) from plane P4 (not shown) by ½" to 1" or is flush with bottom 30B (not shown) and plane P4. It will be understood, however, that the invention is not limited to these specific positions; the purpose of the invention is to effuse a given quantity of gas as small bubbles into the bottom portion, or side portion(s) or center of a channel defined by a metal-transfer device. It is also contemplated that device 900 could be used to release gas into the lower portion of a molten metal stream that has left an outlet port in a manner similar to previously described device 300.

Once block 902 is inserted in opening 1010 of conduit 1002, block 902 can be sealed in opening 1010 using cement or other suitable means, although it is preferably not sealed so that it can be easily removed. Previously described gas-transfer device 200 is threadingly received, or attached by other suitable means, in port 904. A pump (not shown) creates a molten metal stream that exits an outlet port (not shown) and passes into end 1004, through channel 1003, and exits end 1006. Gas is introduced into gas-transfer device 200 and enters port 904 and then passes into passageway 908. Finally, the gas escapes through porous block 914 and effuses into the molten metal stream. Alternatively, gas-release device 900 need not be used with a metal-transfer device 1000. It could instead be used with any of the previously described metal-transfer devices or it could be used in the manner described above for gas-release device 300. Furthermore, previously described gas-release device 500 could be used and positioned in the same manner as gas-release device 900. In that case gas would escape through bores, or openings, 506 into channel 1003.

Figure 24:
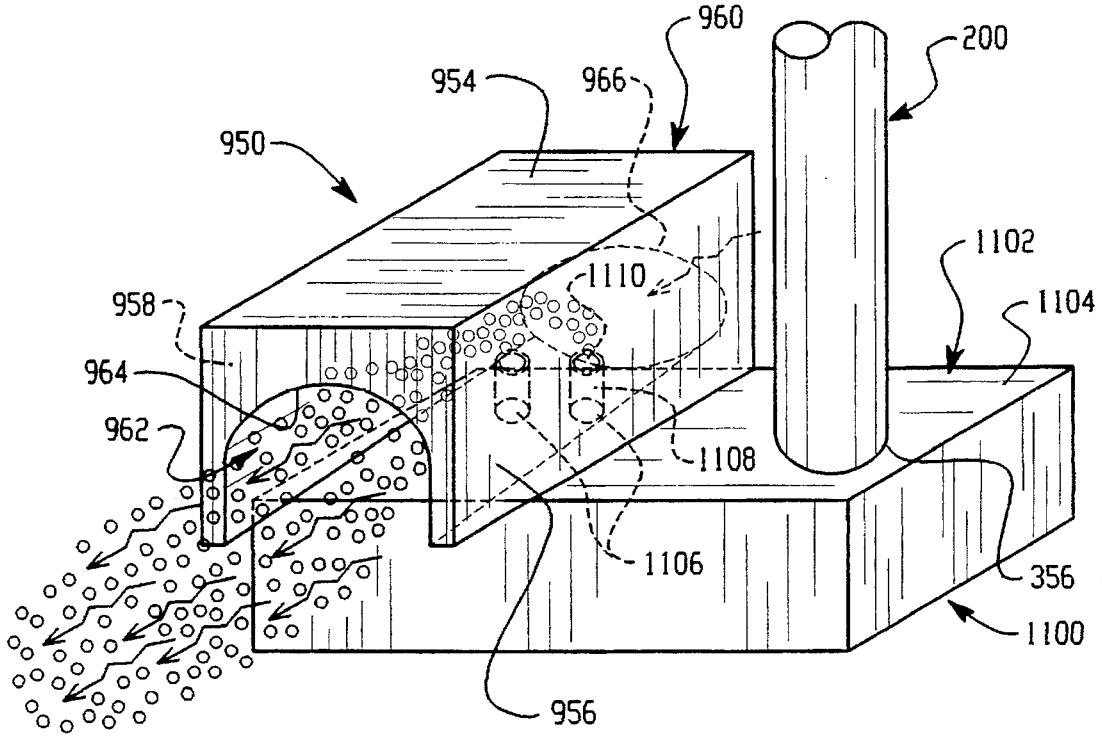
FIG. 24 is a perspective view of a system and device wherein the gas-release device includes gas-release tubes or blades extending from a block into a channel defined by a metal-transfer device.

Another embodiment of the present invention is shown in FIG. 24 wherein a system and device is provided for releasing gas near the center of a molten metal stream contained by a channel defined by a metal-transfer device. A metal-transfer device 950, as previously described, is preferably a 3-sided conduit 952 defining a channel 954, although any of the previously described metal-transfer conduits could be used. A gas-release device 1100 is provided for releasing gas near the center of channel 964. Gas-release device 1100 may take many forms but preferably is a block 1102, similar or identical in structure to previously described block 402, having an upper surface 1104 and gas-release tubes 1106 formed or connected thereto. Gas-release tubes 1106 are preferably ¼"–1" in height, as measured from surface 1104, and are preferably cylindrical, having an annular wall 1108, and have an outer diameter of ½"–1". Preferably, tubes 1106 are positioned so that they extend upward from surface 1104 into channel 964 at a 0–60 degree angle. An opening, or bore, 1110 is formed at the end of each gas-release tube 1106, or alternatively, is formed in annular wall 1110. Each opening 1108 is preferably circular and 1/16"–⅜" in diameter, although other sizes and shapes could be used.

Tube(s) 1106 are inserted into channel 964 from either a side, or both sides, or the bottom or some combination of the sides and bottom. In operation, gas is introduced into a previously described gas-transfer device 200 whereby the gas travels to gas-release device 1100 and passes through opening(s) 1108 in the gas-release tube(s) 1106 and is released into the molten metal stream passing through channel 964.

Figure 25:
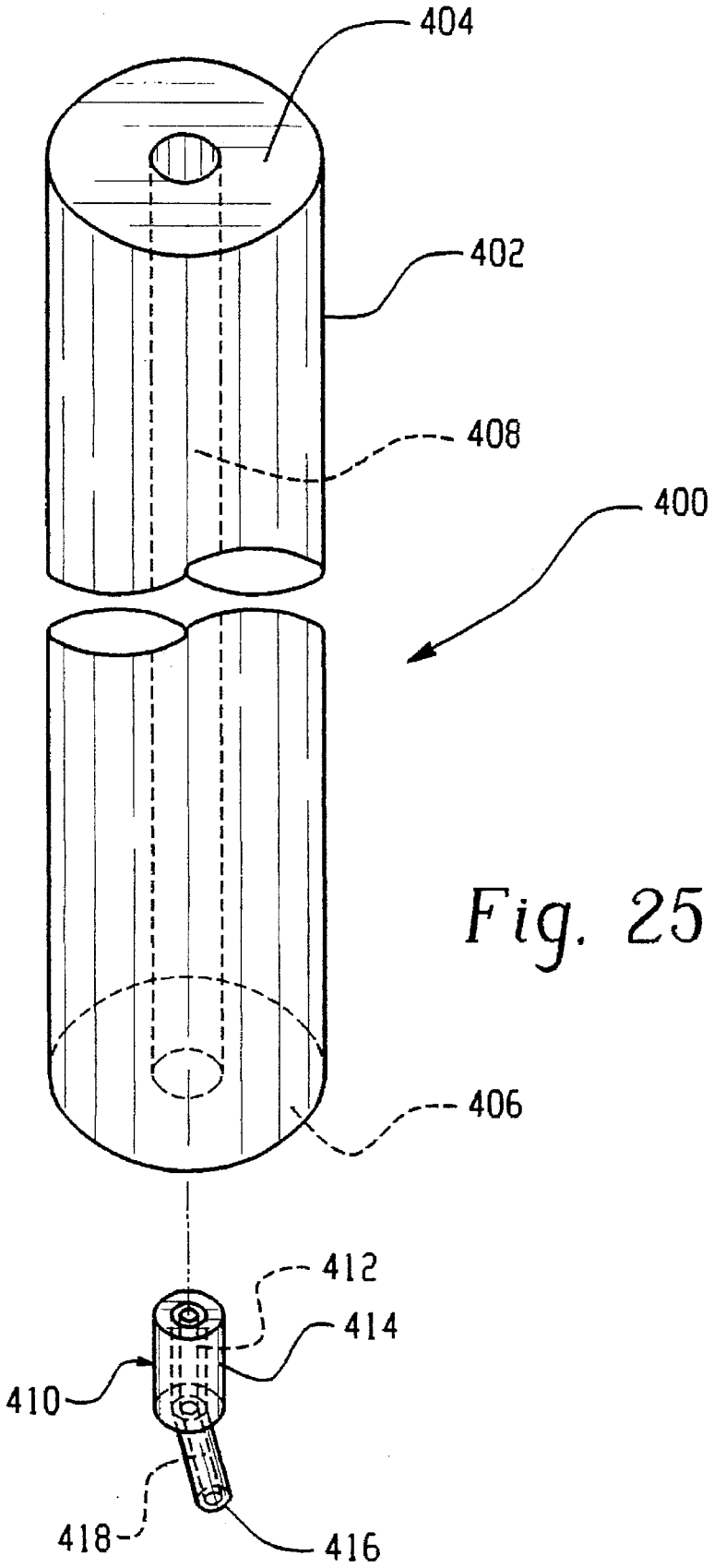
FIG. 25 is an exploded, perspective view of a gas-release device 400 which extends into the upper portion of a molten metal stream.
Figure 26:
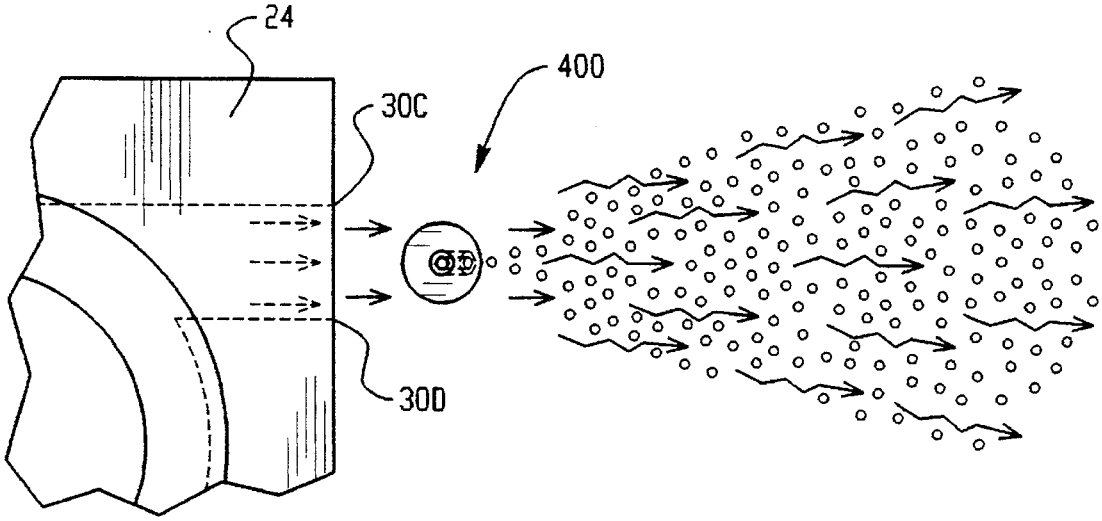
FIG. 26 is a top view of the assembled gas-release device shown in FIG. 25 illustrating gas being released into a molten metal stream.
Figure 27:
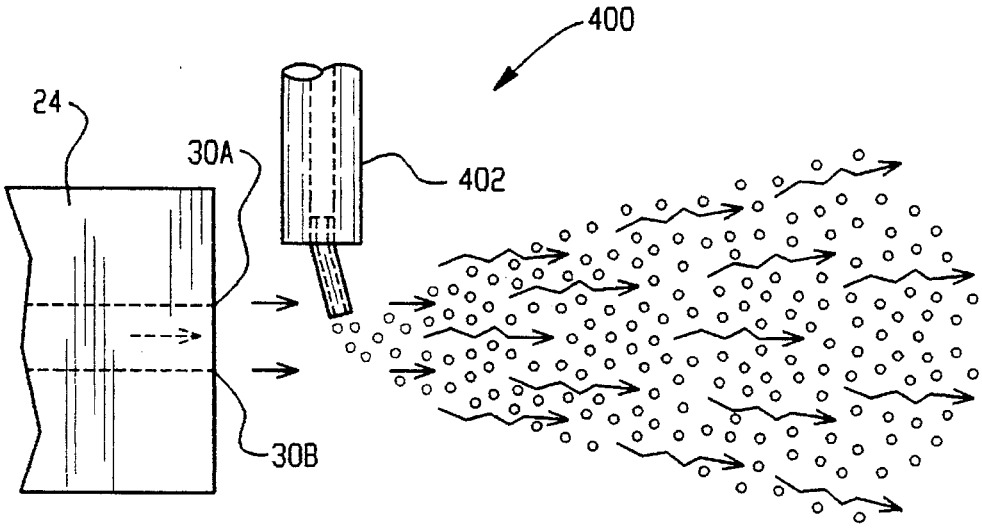
FIG. 27 is a side view of the system and device shown in FIG. 26.

In another embodiment of the present invention, shown in FIGS. 25–27, a system and device are provided for releasing gas into a molten metal stream wherein a gas release device extends through plane P1 into the upper portion of a molten metal stream exiting outlet port 30. A gas-release device 400 is provided that preferably includes a tube 402, formed of the same material and having the same overall dimensions as previously described tube 102. Tube 402 has a first end 404, a second end 406 and a generally cylindrical cavity 408 extending therethrough. A plug 410 is preferably 1" long and has a cavity 412 and has an outer surface 414 dimensioned so that plug 410 can be received in cavity 408. A gas-release tip 416 is preferably 1"–3" long, and most preferably 1" long, and extends downward from plug 410 at a 0° to 60° angle. Tip 416 is hollow, having a cavity 418 and an opening 420. Opening 420 is preferably circular and 1/16" to ⅜" in diameter. Cavity 418 communicates with cavity 414. Tip 416 preferably has an outer diameter of no greater than 1¼" and most preferably 1" or less.

Plug 410 is inserted into cavity 408 at end 406 and can be threading received in cavity 408, or cemented in place or pressure fit or held in place by any other suitable means. Once plug 410 is inserted, tip 416 extends downward from end 406, as best seen in FIG. 27. Gas-release device 400 is positioned with respect to pump base 24 so that tip 416 extends downward into space P (not shown) through plane P1 (not shown) at a 0° to 60° downstream angle, as shown in FIG. 27. Tip 416 is preferably long enough to extend into the center or lower portion of the molten metal stream exiting an outlet port. Because tip 416 has a small surface area, e.g., a diameter of preferably 1" or less, as compared to the prior art, only a small low pressure zone is formed behind it. This reduces the amount of gas that will enter the low pressure zone and more gas will be dispersed into the moving metal stream. Further, the relatively small opening of 1/16" to ⅜" introduces small gas bubbles, as compared to the prior art, which tend to disperse better within the stream.

Figure 28:
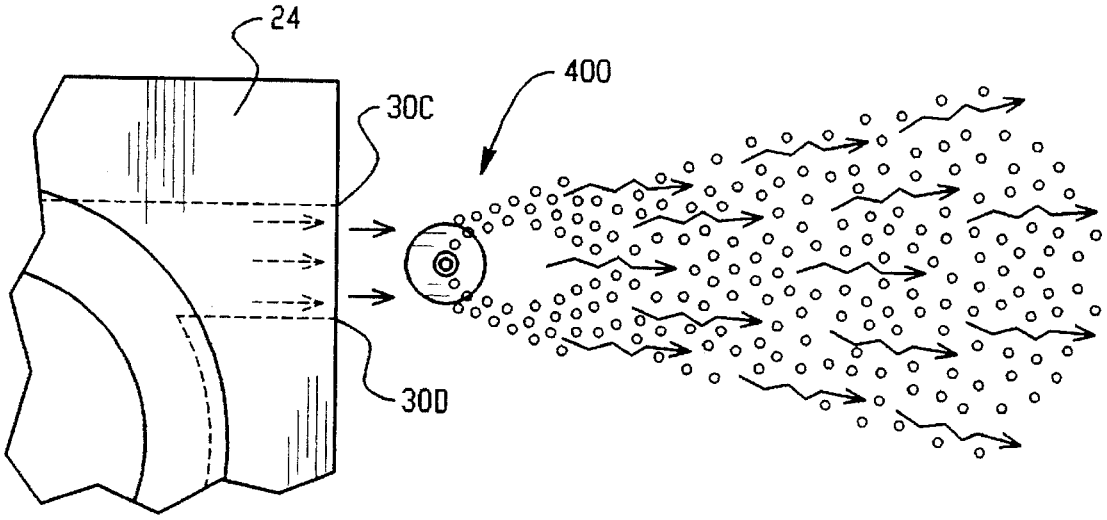
FIG. 28 is a top view of a system and device for releasing gas into a molten metal stream whereby the openings are formed in the body of a gas-release tip.

Additionally, the end of tip 416 may be plugged or otherwise closed. In that case, openings are formed in the cylindrical body of tip 416. Gas-release device 400 would then be positioned with respect to outlet port 30 so that the openings are substantially perpendicular to the flow of the stream, as shown in FIG. 28. It is not necessary, however, that the openings be positioned in this manner, the purpose of positioning the openings being to minimize the chance that the gas will enter the low-pressure zone behind tip 416. It will also be understood that more than one gas-release devices 400 can be used and/or more than one tip 416.

Furthermore, device 400 could be used in conjunction with a metal-transfer device to release gas into a molten metal stream passing through a channel defined by the metal-transfer device. In that case the gas-release tip would extend down from the top of the metal-transfer device into the bottom portion, top portion or side portion of the stream.

The specific structures described herein merely describe preferred embodiments of the invention. In all of the above-described embodiments, the openings, apertures or bores thorough which the gas is released into the molten metal stream may be of any number, shape, size and may be positioned relative each other in anyway. Additionally, the metal-transfer devices and gas-release devices disclosed herein could be connected in any way or need not be connected so long as released gas enters the channel defined by the metal-transfer conduit; this being referred to as the gas-release device being in communication with the metal-transfer device, as previously mentioned. Furthermore, porous materials, such as ceramic, may be used as covers or plugs or insets in conjunction with, or in place of, any of the openings, apertures or bores heretofore described. Further, these porous materials may be integrally formed with one or more the components of the invention such as the gas-release device, metal-transfer device or gas-transfer device in place of a bore, opening or aperture. Finally, although graphite impregnated with oxidation-resistant solution is the preferred material for forming the gas-release devices, gas-transfer devices and metal-transfer devices disclosed herein, any material capable of functioning in a molten-metal environment could be used.

Having thus described preferred embodiments of the invention, other variations and embodiments that do not depart from the spirit of the present invention will become readily apparent to those skilled in the art. The scope of the present invention is thus not limited to any one particular embodiment but is instead set forth in the appended claims and the legal equivalents thereof.

What is claimed is:

1. A system for removing impurities from molten metal comprising:

a) a pump for creating a molten metal stream, said pump having a pump chamber including an outlet port with a top, a bottom, and two upwardly extending sides, through which said molten metal stream passes;

b) a gas-release device positioned outside of said pump chamber adjacent the bottom of said outlet port, said gas-release device having one or more gas-release bores; and c) a gas-transfer device for transferring gas to said gas-release device, said gas-transfer device connected to said gas-release device;

Whereby molten metal is pumped through said outlet port past said gas-release device and gas is introduced into said gas-transfer device to said gas release device where gas escapes through said gas-release bores and rises into the molten metal stream.

2. A system as defined in claim 1 wherein said gas-release device comprises a block of graphite.

3. A system as defined in claim 1 wherein said gas-release bores are 1/16" to 3/8" in diameter.

4. A system as defined in claim 1 wherein said gas-release device has a generally planar upper surface and said gas-release bores are oriented in said surface at a 0°–60° downstream angle.

5. An apparatus for removing impurities from molten metal comprising:

a) a gas-release device for releasing gas into the lower portion of a molten metal stream, said gas-release device having a gas-inlet port and one or more gas-release bores, said gas-inlet port in communication with said one or more gas-release bores; and b) a gas-transfer device for transferring gas to said gas-release device, said gas-transfer device having a first end connectable to a gas source and a second end that communicates with said gas-inlet port, and a cavity extending between said first end and said second end;

whereby the first end of said gas-transfer device is connected to a gas source and gas is introduced into said gas-transfer device where it passes through said cavity and out of said second end into said inlet port and escapes through said one or more gas-release bores into the lower portion of a molten metal stream or flow.

6. A system as defined in claim 5 wherein said gas-release device comprises a block of graphite.

7. A system as defined in claim 5 wherein said one or more gas-release bores comprises two gas-release bores.

8. A system as defined in claim 7 wherein said one or more gas-release bores has a diameter of 1/16" to 3/8".

9. A system as defined in claim 8 wherein said gas-release device has an upper surface and said one or more gas-release bores are formed in said upper surface at a 0°–60° downstream angle.

10. A system as defined in claim 5 wherein said gas-release device and said gas-transfer device are integrally formed.

11. An apparatus for introducing gas into molten metal comprising in combination:

a) a pump for creating a molten metal stream, said pump having a base and a metal-transfer device, said metal-transfer device defining a channel with a top, bottom and two upwardly extending sides through which said molten metal stream passes;

b) a gas-release device for releasing gas into the bottom of said channel, said gas-release device positioned adjacent the bottom of said channel and having one or more gas-release bores; and c) a gas-transfer device for transferring gas to said gas-release device, said gas-transfer device having a first end connectable to a gas source and a second end connected to said gas-release device and an inner cavity extending between said first end and said second end;

whereby said pump pumps a molten metal stream through said channel defined by said metal-transfer device and gas is transferred from said gas source, through said gas-transfer device, into said gas-release device where it escapes through said gas release bores and is released into said molten metal stream.

12. A system as defined in claim 11 wherein said base further includes an outlet port and said metal-transfer device is connected to said outlet port.

13. A system for introducing gas into molten metal comprising:

a) a pump for creating a molten metal stream, said pump having a base and an outlet port in said base through which said molten metal stream passes;

b) a metal-transfer device for containing said molten metal stream, said metal-transfer device in communication with said outlet port and defining a channel with a top, bottom and two upwardly extending sides through which said molten metal stream passes; and c) a gas-release device for releasing gas into said channel, said gas-release device positioned at least partially on a side of said metal-transfer device and having a gas inlet and one or more gas release bores positioned on at least one upwardly extending wall of said channel that communicate with said channel;

d) a gas-transfer device for transferring gas to said gas-release device, said gas-transfer device having a first end connectable to a gas source and a second end that communicates with said gas-inlet, and an inner cavity extending between said first end and said second end;

whereby said pump pumps a molten metal stream through said channel defined by said metal-transfer device and gas is transferred from said gas source, through said gas-transfer device, into said gas-release device where it escapes through said gas-release bores and is released into said molten metal stream.

14. A system for removing impurities from molten metal comprising:

a) a pump creating a molten metal stream, said pump having a pump chamber including an outlet port, said outlet port having a top, a bottom, and two upwardly extending aides connecting the top and bottom, through which said molten metal stream passes; and b) a gas-release device for introducing gas into said stream, said gas-release device positioned adjacent either the bottom or both upwardly extending sides of the outlet port, and having one or more openings adjacent the bottom or upwardly extending sides of the outlet port, said gas-release device connectable to a gas supply;

whereby molten metal is pumped through said outlet port past said gas-release device and gas is introduced into said gas-release device, the gas escaping from the gas-release device through said openings in said gas-release device and entering said molten metal stream.

15. A system as described in claim 14 wherein said gas-release device comprises one or more hollow graphite tubes.

16. A system described in claim 4 wherein said gas-release device comprises two graphite tubes, one adjacent each upwardly extending side of said outlet port.

17. A system as defined in claim 14 wherein each of said openings are 1/16" to 3/8" in diameter.

18. A system as defined in claim 14 wherein said openings are positioned at a 0°–60° downstream angle relative the molten metal stream.

19. A system as defined in claim 17 wherein said openings are positioned at a 0°–60° downstream angle relative the molten metal stream.

20. A system as defined in claim 17 wherein said gas-release device includes two openings, each of which has a center, said openings being spaced ½" to ¾" apart, as measured between the centers.

21. In a system for removing impurities from molten metal comprising a pump including an outlet port, and alas release device adjacent a side of said outlet port, said gas release device including a gas release tube comprising oxidation resistant graphite, said gas release tube comprising an elongated, heat resistant member having an elongated inner cavity extending therethrough, s first end, and a second end, said first end having an opening communicating with said inner cavity and connectable to a gas supply, said second end being closed, said gas release tube further comprising one or more openings of smaller diameter than said second end, and adjacent said second end, whereby gas is introduced through said first end, into said inner cavity, and out said openings into a pumped molten metal stream.

22. A process for releasing gas into a pumped molten metal stream, the process comprising the steps of:

a) providing a molten metal bath;

b) providing a pump within said molten metal bath, said pump including an outlet port;

c) providing a gas-release device within said molten metal bath, said device positioned relative to the outlet port so that gas is released into a lower portion of the pumped molten metal stream;

d) connecting the gas-release device to a gas source;

e) operating the pump, thereby creating a pumped molten metal stream exiting the outlet port;

f) releasing gas from gas-release device into the lower portion of said pumped molten metal stream exiting the outlet port.

* * * * *